US006976600B2

(12) United States Patent
Yoneyama et al.

(10) Patent No.: US 6,976,600 B2
(45) Date of Patent: Dec. 20, 2005

(54) BLOW-MOLDED CONTAINER THAT IS PEELABLY LAMINATED

(75) Inventors: Masashi Yoneyama, Matsudo (JP); Hiroyuki Nakamura, Koto-ku (JP); Masato Seguchi, Buzen (JP); Takayuki Goto, Koto-ku (JP)

(73) Assignee: Yoshino Kogyosho Co., Ltd., Tokyo (JP)

( * ) Notice: Subject to any disclaimer, the term of this patent is extended or adjusted under 35 U.S.C. 154(b) by 170 days.

(21) Appl. No.: 10/432,961

(22) PCT Filed: Oct. 31, 2002

(86) PCT No.: PCT/JP02/11356

§ 371 (c)(1),
(2), (4) Date: Jul. 2, 2003

(87) PCT Pub. No.: WO03/037726

PCT Pub. Date: May 8, 2003

(65) Prior Publication Data

US 2004/0060889 A1 Apr. 1, 2004

(30) Foreign Application Priority Data

Oct. 31, 2001 (JP) ..... 2001-335631
Oct. 31, 2001 (JP) ..... 2001-335632
Jul. 31, 2002 (JP) ..... 2002-223859

(51) Int. Cl.[7] ..... B65D 23/02; A47J 41/02
(52) U.S. Cl. ..... 215/12.1; 215/385; 215/902; 220/495.04; 220/676; 220/723; 220/913
(58) Field of Search ..... 215/12.1, 12.2, 215/381, 900, 385, 902; 220/495.04, 666, 220/676, 723, 913

(56) References Cited

U.S. PATENT DOCUMENTS 4,372,455 A * 2/1983 Cochran ..... 215/385
5,513,761 A * 5/1996 Kobayashi et al. ..... 215/12.1
2004/0069735 A1 * 4/2004 Yoneyama et al.

FOREIGN PATENT DOCUMENTS

JP U-57-44063 3/1982
JP 4267727 * 9/1992

(Continued)

*Primary Examiner*—Sue A. Weaver
(74) *Attorney, Agent, or Firm*—Oliff & Berridge, PLC

(57) ABSTRACT

A blow-molded container of this invention comprises: an outer layer (11) of a synthetic resin, which forms the outer shell of a finite shape; an inner layer (12) of a flexible synthetic resin, which is peelably laminated with the outer layer (11) and forms an inner bag; and a pair of restricted zones (15) of a vertical broad strip type, which is formed axisymmetrically on the central axis of container (1) to adhere and fix the outer layer (11) and the inner layer (12) over the entire height and is located so as to avoid the positions of air introduction ports (7) that have been provided in the outer layer (11) to introduce air into the void between the outer layer (11) and the inner layer (12). At least one of the restricted zones (15) comprises two or more adhesive zones (14) of the vertical strip type, which are parallel to each other. In this configuration, a container of the delaminated type is provided, which has a sufficiently high mechanical strength at the bottom and which can be molded in an ordinary mold at a high rate of productivity. This invention also provides a container of the squeezable type, which has uniform, favorable squeezability, no strange feel to the touch, and a less deteriorated outer appearance caused by the provision of adhered zones.

17 Claims, 24 Drawing Sheets

FOREIGN PATENT DOCUMENTS

| | | | |
|---|---|---|---|
| JP | U-7-22951 | | 4/1995 |
| JP | A-8-26241 | | 1/1996 |
| JP | A-8-216238 | | 8/1996 |
| JP | 9-77136 | * | 3/1997 |
| JP | 2000-16469 | * | 1/2000 |
| JP | A-2000-16459 | | 1/2000 |

* cited by examiner (a)

(b)

BLOW-MOLDED CONTAINER THAT IS PEELABLY LAMINATED

TECHNICAL FIELD

This invention relates to a peelably laminated, blow-molded container made of synthetic resins, which is obtained by peelably laminating an outer layer that forms an outer shell of a definite shape and an inner layer that forms a deformable inner bag, so that the content can be discharged and used without changing the outer appearance of this container.

This invention also relates to a blow-molded container made of synthetic resins, which has been obtained by laminating peelably an inner container that can be deformed with the decrease in its content and a squeezable outer container, so as to enable the content to be discharged and used repeatedly without sucking up outside air into the inner container.

BACKGROUND OF THE INVENTION

Peelably laminated containers made of synthetic resins are known and obtained by peelably laminating an outer layer that forms an outer shell of a finite shape and an inner layer that forms a deformable inner bag. These blow-molded bottles are generally referred to as delaminated bottles.

An outer parison and an inner parison having no compatibility with each other are first extruded together to give a laminated parison. This laminated parison is then blow-molded into the peelably laminated synthetic resin container. At that time, the bottom portion is pinched with the pinch-off of the blow mold and is pressed flat to form a bottom seal. Since the bottom seal has basically a laminated structure consisting of the outer layer and the inner layer, which are not compatible with each other, there was dissatisfaction in that the outer layer is easily cracked at the bottom.

As a conventional art to relieve this dissatisfaction, there is Japanese Laid-Open Patent Application No. 1996-216238. In the configuration of that invention, the bottom portion is pinched with the pinch-off of the blow mold and is pressed flat to form the bottom seal, as described above, but the seal is overlaid with a pair of ribs and pressed together so that a ridge is formed along the parting line. Some interlocks are provided at several points along the seal as both ribs bite into each other.

In this conventional art, the bottom seal is formed into a ridge having a certain height and width. As a result, the bottom seal has a large area of pressed contact between the outer layer and the inner layer. The interlocks provided at several points not only increase the area of pressed contact further, but also increase resistance to the shearing force that is parallel to the plane of pressed contact, thereby making it possible to obtain a bottom seal having a mechanical strength that is high enough to prevent the bottom seal from cracking.

However, in the above-described conventional art, there are cases of cracking in the bottom seal because of the effect of time-lapsed shrinkage at the bottom, which takes place after the containers have been blow-molded. The problem of bottom cracking is often found especially in large-size containers of this conventional art when they are dropped to the floor or when they experience a shock.

However, in the above-described conventional art, there are cases of cracking in the bottom seal because of the effect of time-lapsed shrinkage at the bottom, which takes place after the containers have been blow-molded. The problem of bottom cracking is often found especially in large-size containers of this conventional art when they are dropped to the floor or when they experience a shock.

Therefore, the blow-molded containers of this kind are required to go through complete cool-down and shrinkage within the mold. A problem arises here because the bottom seal has large height, thickness, and cubic volume, which need long hours of cooling and thus result in quite low efficiency in the production of containers.

Utility models laid open No. 1982-44063 and No. 1995-22951 describe conventional-art pouring vessels of the squeezable type, which comprise an inner container and an outer container in which to put the inner container.

The conventional art described in utility model laid open No. 1982-44063 refers to a pouring vessel comprising an inner container and an outer squeezable container having an air hole at the bottom. The content is discharged from the inner container by squeezing the outer container. Then, outside air is introduced into the void between the outer container and the inner container. At that time, the inner container maintains its deformed shape, while the outer container returns to the original shape because of its restoring force.

The conventional art described in utility model laid open No. 1995-22951 refers to another pouring vessel comprising an inner container and an outer squeezable container combined and fitted to each other. The inner container is provided with the first check valve that permits the content to pass through the valve and come out of the inner container but does not permit outside air to enter the inner container. The outer container is provided with the second check valve that permits outside air to enter the void between both containers, but does not permit air to escape from the void.

The method of utilizing a pair of adhered zones of the vertical strip type is also generally in use. These adhered zones adhere and fix the outer container and the inner container to each other over the entire height of the containers and restrict the deflationary deformation so as to keep the inner container at a certain shape that gives no shrinkage in the height direction, thereby ensuring the flow path for the content and making the discharge operation smooth. A simple and effective method is to dispose a pair of adhered zones at axisymmetric positions on the central axis of the body.

However, in order to make the adhered zones fulfill their function, it is necessary for these adhered zones to have a certain width. The adhered zones thus formed naturally have to be thick. On the other hand, the rest of the body of the outer container comprises a relatively thin wall so that the body gives flexibility to the squeezable container. Here is where problems arise. A problem is that the adhered zone forms a rib that prevents uniform squeezable deformation. Another problem is that the users feel strangeness in the touch with a hand. Still another problem is that the adhesive resin used to form the adhered zone is expensive.

The outer surface of the container body is usually an important portion of a commercial product from an outer-appearance point of view because a label is attached or printed on this surface to show the product name, and/or decoration is added. The formation of adhered zones causes irregularity on the outer surface of the body, and this irregularity is a process problem as well as the appearance problem. Furthermore, the rib-like adhered zones are conspicuous by themselves.

This invention has been made to solve these problems in the conventional art, owing to the configuration, such as the number and disposition, of the adhered zones of the vertical strip type used to adhere and fix the outer layer (the outer container) and the inner layer (the inner container).

Firstly, the technical problem of this invention is to achieve strong adhesion at the bottom seal between the outer layers and the inner layers, or between outer layers themselves by way of the inner layers, without increasing the bulk of the bottom seal. An object of this invention is to provide a peelably laminated, blow-molded synthetic resin container having high productivity and economical efficiency without a decrease in the bottom strength and the ability of the container to sit on the bottom.

Secondly, another technical problem of this invention is to form the adhered zones that minimize their adverse effect on the outer appearance and enable the outer container to be uniformly squeezed. Another object of this invention is to provide a blow-molded container of the squeezable type at a low cost, which is capable of achieving smooth discharge operation to the last moment and having highly aesthetic appearance.

DISCLOSURE OF THE INVENTION

Among the means of solving the above-described technical problem, the means of carrying out the invention of claim 1 has the configuration of a peelably laminated, blow-molded synthetic resin container, which comprises: an outer layer of a synthetic resin, which forms the outer shell of a finite shape; an inner layer of a flexible synthetic resin, which can be peelably laminated with the outer layer and forms an inner bag; and a pair of restricted zones of a vertical strip type, which are disposed axisymmetrically on the central axis of the container to adhere and fix the outer layer and the inner layer over the entire height and are located so as to avoid the positions of air introduction ports that have been provided in the outer layer to introduce air into the void between the outer layer and the inner layer. At least one of the restricted zones comprises two or more adhesive zones of the vertical strip type, which are parallel to each other.

In the configuration of claim 1, a pair of restricted zones is disposed axisymmetrically on the central axis of the container to adhere and fix the outer layer and the inner layer over the entire height of the body. Air introduction ports are located between the pair of restricted zones. Due to these restricted zones and the air introduction ports, it is possible to achieve the smooth discharging operation and to control the shape of the inner bag formed by the inner layer, which is deflated and deformed with a decrease in the content.

At the container bottom, the restricted zones are capable of adhering the outer layers and the inner layers on the bottom seal and increasing the strength of this bottom seal.

In the configuration of claim 1, either or both of the restricted zones comprise two or more adhered zones of the vertical strip type. The restricted zones are given a width that is necessary and sufficient to control the deformation of the inner layer caused by the decrease in the content or to increase the strength of the bottom seal without widening the width of the adhered zones themselves. Solutions can be brought about to the problem of poor outer appearance caused by a broad width of the adhered zones, the problem of inhibited uniform squeeze, the problem of strange feel the users have in touching the container with a hand, and the problem of minimizing the use of the costly adhesive resin to form the adhered zones.

In the configuration of claim 1, at least one of the restricted zones comprises two or more adhesive zones of the vertical strip type, which are parallel to each other. This is because action and effect of claim 1 are demonstrated simply when one out of the two restricted zones comprises two or more adhered zones. The configuration of claim 1 allows both restricted zones to have two or more adhered zones, or allows only one restricted zone to have two or more adhered zones, depending on the purpose of using the container.

The means of carrying out the invention of claim 2 comprises, in the invention of claim 1, that a pair of restricted zones is provided at positions opposite to each other and is separated from each other by the parting line and that the lower ends of one restricted zones are disposed at the partly or wholly end-to-end position facing those of the other restricted zone on the bottom seal formed when the bottom portion of parison is pressed flat with the pinch-off of a blow mold.

The container is blow-molded in a blow mold having an ordinary pinch-off structure. Like in ordinary blow moldings, the bottom seal is a pinch-off portion formed at the bottom, and takes the shape of a ridge with a low protrusion, in which a pair of ribs is brought together. These ribs serve to weld firmly the inner layers that have been overlaid by the pinch-off.

Since the bottom seal of this container has as fully small a cubic volume as in ordinary blow-molded containers, the seal portion can be cooled down quickly and sufficiently before the container is released from the mold.

Both restricted zones are disposed at positions opposite to each other and are separated from each other by the parting line. The lower ends of both restricted zones are located at the tip of each rib (the pinch-off portion) on the bottom seal that extends along the parting line. At the ribs where there are the lower ends of both restricted zones, the outer layers and the inner layers are strongly adhered and fixed to each other over the width of the lower ends of the adhered zones.

The three points, i.e., both ends of the bottom seal and the above-described portions where the outer and inner layers are strongly adhered and fixed at the lower ends of the restricted zones, serve as the junctions against the deformation of the laminated bottom seal. Individual deformation of the outer layer and the inner layer is inhibited also in the rest of the bottom seal in which there is no restricted zone. As a result, even if any force is applied on the bottom seal, the seal is able to resist the force and is protected against cracking.

In a similar manner, space can be left between plural adhered zones belonging to the same restricted zone so that the width range of the restricted zones can be widened. This enables these adhered and fixed portions to serve securely as a junction, and effectively inhibits the individual deformation of the outer layer and the inner layer. Thus, sufficient crack-preventing effect can be obtained.

Since at least one restricted zone has been designed to have two or more adhered zones of the narrow strip type, it is possible to reduce greatly the amount of the costly adhesive resin material to be used for the restricted zones of a desired width. It also becomes possible to set freely the end-to-end facing relationship between the lower ends of both restricted zones at the bottom seal without requiring any rigorous alignment.

The invention of claim 3 includes the configuration of the invention of claim 2, and in addition, comprises that each restricted zone has two or more adhered zones.

In the invention of claim 3, it has become possible to mold the restricted zones of a larger width from a smaller amount of the adhesive resin material because each restricted zone comprises more than one adhered zone. The width of the restricted zones can be changed easily in its setting.

The invention of claim 4 includes the configuration of the invention of claim 3, and in addition, comprises that each of the restricted zones comprises a plural, same number of adhered zones.

In the invention of claim 4, the restricted zones of a large width can be formed with a smaller amount of the adhesive resin material than usual, and the width of the restricted zones can be easily set or changed, because both restricted zones comprise two or more adhered zones. In addition, the lower ends of one restricted zone can be easily set to take a posture facing the opposite lower ends of the other restricted zone because the lower end of each adhered zone can be disposed at the end-to-end position facing the lower end of the opposite adhered zone.

The invention of claim 5 includes the configuration of the invention of claim 2, 3, or 4, and in addition, comprises that the lower end of each adhered zone belonging to one restricted zone is disposed at the wholly end-to-end position facing the lower end of an adhered zone belonging to the other restricted zone.

In the invention of claim 5, the lower end of at least one restricted zone are positioned quite close to that of the other restricted zone by way of the welded inner layers. Thus, the lower ends of both restricted zones are put in a state almost similar to the direct bonding between the lower ends facing each other. Strong adhesive bonding can be obtained at the bottom seal where there are the lower ends of the restricted zones.

The invention of claim 6 includes the configuration of the invention of claim 2, 3, or 4, and in addition, comprises that the lower end of each adhered zone belonging to one restricted zone is dislocated from that of the corresponding adhered zone belonging to the other restricted zone to a maximum degree within a range that corresponding portion of the inner layer is not flexibly deformed.

In the invention of claim 6, there is little flexible deformation in the inner-layer portion sandwiched between the two opposite lower ends of the adhered zones even if the lower ends are dislocated from each other to such a degree that corresponding portion of the inner layer is not flexibly deformed. This hardly deformed inner-layer portion firmly connects both of the ribbed portions where the outer layers and the inner layers have been adhered and fixed by the adhered zones. Because these ribbed portions are located at positions adjacent to each other to form a ridge and to back up the lower ends of the restricted zones, the bottom seal is stably maintained at a definite shape without being deformed at random.

As long as the bottom seal having the lower ends of the restricted zones fixed therein is maintained at a stable shape, the bottom seal receives no external force that may peel the outer layers and the inner layers from each other. As a result, bonding between the outer layers and the inner layers remains relatively stable.

The means of carrying out the invention of claim 7 comprises, in the invention of claim 2, that each of the pair of restricted zones consists of a pair of adhered zones and that the lower end of each adhered zone on one side is disposed at the wholly end-to-end position facing the lower end of another adhered zone on the other side.

In the configuration of claim 7, the two each of adhered zones are disposed at positions opposite to the remaining two on the other side separated by the parting line. The lower ends of one pair of adhered zones are disposed on the bottom seal at the wholly end-to-end positions facing those of the other pair. At these two end-to-end positions, the outer layers on both sides of the parting line and the inner layers sandwiched by these outer layers are strongly adhered and fixed by these adhered zones over the entire width of the lower end of each adhered zone.

There is no adhered zone in the middle zone between two each of adhered zones that are in their end-to-end facing positions on the bottom seal. Since, however, the outer layers and the inner layers are strongly adhered by way of the adhered zones on both sides of this middle zone, the outer and inner layers of the middle zone shows integrated deforming behavior, and consequently, can be regarded as a single adhered and fixed portion having outer and inner layers strongly adhered over a wide range including the width of both adhered zones and the width of the middle zone.

The three points, i.e., both ends of the bottom seal and the above-described single adhered and fixed portion, serve as the junctions against the deformation of the laminated bottom seal. Individual deformation of the outer layer and the inner layer is inhibited also in the rest of the bottom seal other than the restricted zones. As a result, even if any force is applied on the bottom seal, the seal is able to resist the force and is protected against cracking. The width of each restricted zone can be regarded as an adhered and fixed portion, which performs securely the function of a junction to inhibit the individual deformation of the outer layer and the inner layer effectively. Thus, sufficient crack-preventing effect can be obtained.

As described above, the outer layers and inner layers show integrated behavior over the width of each restricted zone, which includes the width of the pair of adhered zones on the same side and the width of the middle zone. It is possible, therefore, to set the adhered zones at a narrow width and to reduce the amount of the costly adhesive material to be used.

The restricted zones extend over the entire height of the body, and perform the function to restrict the deflationary deformation of the inner layers. Because of these restricted zones, the content can be smoothly discharged.

The invention of claim 8 includes the invention of claim 2, 3, 4, 5, 6, or 7, and in addition, comprises that the restricted zones are set to have such a width that the deformable inner layers are able to block up the cross-sectional flow path in the body of the container right when the content has been consumed.

In the configuration of claim 8, the body can be prevented from complete deflationary deformation in the state that the content still remains in the inner bag. As seen from the cross-section, the body is completely pressed flat right when the content has been consumed. Thus, it is possible to secure the content flow path and to maintain good discharging ability until the content is totally consumed.

The invention of claim 9 includes the invention of claim 2, 3, 4, 5, 6, 7, or 8, and in addition, comprises that the air introduction ports are disposed, axisymmetrically on the central axis, at two points in the outer layers near the parting line.

In the configuration of claim 9, outside air comes in through the air introduction ports disposed near the parting line. Thus, the deflationary deformation of the inner layers can be allowed to proceed in the symmetrical pattern, and the content can be smoothly discharged.

The means of carrying out the invention of claim 10 comprises, in the invention of claim 1, that the outer layer forms an outer container, which has the flexibility to make this container squeezable and recoverable to its original shape; that the inner layer forms an inner container for receiving its content inside and can be deflated and deformed inward with the decrease in inner pressure; and that each of the two restricted zones comprises a pair of adhered zones.

The container having the configuration of claim 10 can be used to provide a pouring vessel of the squeezable type. Each restricted zone of the vertical strip type comprises a pair of adhered zones and a space sandwiched by these adhered zones where the outer layer and the inner layer are not adhered to each other (hereinafter referred to as unadhering middle zone). The restricted zone, with its total width including the width of two adhered zones on the same side and the width of the unadhering middle zone, has the action and effect to restrict the deflationary deformation of the inner layer.

The inner container is restricted from excessive deflationary deformation when a pair of restricted zones is formed, axisymmetrically on the central axis of the outer container, over the roughly entire height of the container. As observed in the cross-section of the body, a pair of unadhering inner-layer portions (hereinafter referred to as deformable inner layers) is located on both sides of each restricted zone. The deformation of the inner container begins with denting the central portions of the deformable inner layers and proceeds along with the discharge of the content caused by the squeeze operation.

A pair of adhered zones, with which to form a restricted zone, is formed from adhesive resin strips by the blow molding process. This process enables these adhered zones to be made narrow within a range afforded from technical and productivity points of view. Thus, the restricted zones would not become thick or rib-like over the total width, and uniform squeezable deformation can be secured over the entire container body. And it is possible to eliminate the strange touch of vertical rib-like zones, which the users feel during the squeeze.

Also, it is also possible to lower the amount of adhesive resin to be used to form the adhered zones. Since this adhesive resin is generally expensive, the cost of materials can be reduced to a low level.

The means of carrying out the invention of claim 11 comprises, in the invention of claim 10, that the discharge cap is screwed on the neck and is provided with the first check valve that prevents the back flow of the content into the inner container and also prevents the inflow of outside air; that the second check valve is provided to open or close the air introduction ports in a manner that makes it impossible for air to escape therefrom; and that the container is used as a pouring vessel.

In the invention of claim 11, there is provided a pouring vessel of the squeezable type, which prevents the inflow of outside air. The pouring vessel is first squeezed to discharge the content. When the squeeze is stopped and the pressure is released, the outer container begins restoring its original shape because of its resilient, restoring force. At the same time, the first check valve provided in the discharge cap is in action to stop the discharge of the content and to prevent the back flow of the content and the inflow of outside air into the inner container. Since the inner container remains deformed with the decrease in the volume of content, outside air is introduced into the void between the outer layer and the inner layer through the air introduction ports, and the outer container is restored to its original shape.

If the pouring vessel is squeezed again in the state in which the outer container has been restored to its original shape, air in the void is pressurized by the squeeze because the second check valve mechanism seals the void. Thus, a pressure is applied on the inner container to discharge the content further.

Since the first check valve prevents the inflow of outside air into the inner container, there is no airspace in the inner container. The content is thus always located in the state connected to the opening. No matter what position the pouring vessel takes when it is used, the content can be discharged easily and quickly. It is also possible to protect the content from decomposition or deterioration caused by air oxidation.

The positions of the second check valves are not specifically restricted, but if the air introduction ports are disposed at the neck, for example a method of positioning the second check valves is to dispose the valves on the discharge cap at positions opposite to these air introduction ports.

The means of carrying out the invention of claim 12 comprises that, in the invention of claim 10 or 11, a pair of restricted zones is provided near the right and left parting lines of the container.

In the configuration of claim 12, the front and rear portions of the body are provided between the two parting lines, and a label is attached or printed on the front surface. The front and rear surfaces can be made smooth with no irregularity, by locating the restricted zones near the respective parting lines. In this configuration, there is also provided a pouring vessel having good outer appearance and high value as a commercial product.

The means of carrying out the invention of claim 13 comprises that, in the invention of claim 12, the vertical centerline of each restricted zone is located right on the parting lines.

In the configuration of claim 13, the restricted zones can be disposed at right angles from the front of the container. This makes outer appearance further better. Good operability and discharging ability can be obtained since the inner layers can be deformed symmetrically to the line connecting the right and left parting lines.

The means of carrying out the invention of claim 14 comprises that, in the invention of claim 12, the vertical centerline of each restricted zone is dislocated from the position of the parting line.

The container is usually blow-molded in a split mold having a pinch-off structure. The bottom seal of the container in the bottom pinch-off portion comprises the inner layers sandwiched from both sides by the outer layers. In this portion, too, the outer layer is peelable from the inner layer.

In the blowing process, the bottom seal is formed by pinching the cylindrical parison from both sides of the bottom portion with the pinch-off of the split mold in a direction perpendicular to the parting line and then pressing the parison flat. If the vertical centerline of each restricted zone is dislocated from on the parting line in the configuration of claim 14, one of the adhered zones is located more distantly from the parting line than the other one of the adhered zones with which to form a restricted zone. At the bottom seal, the adhered zones on the far side from the parting line come rather close to the center of the flattened bottom in their pinch-off state.

The inner layers and the outer layers can be adhered to each other at two points close to the center of the flattened bottom seal. These two points plus the remaining two points at both ends of the seal serve as the junctions against deformation of the bottom seal, which is a laminate comprising the inner layer and the outer layer. Even if some force is applied on the bottom seal, these four fixed points can cope with this force, and enables the bottom seal to be prevented securely from cracking.

The means of carrying out the invention of claim 15 comprises that, in the invention of claim 10, 11, 12, 13, or 14, the body has a circular cross-sectional shape.

In the configuration of claim 15, the squeezable container can be used with no regard to the position of holding the container if the body is cylindrical. In the case of a body having a circular cross-section, it is usually necessary to set a large width of the restricted zones to obtain good discharge operation, as compared to the case of a body having a compressed cross-section, such as an ellipse. In the configuration of claim 15, however, each restricted zone is formed by a pair of narrow adhered zones of the vertical strip shape and a space in between. Consequently, the wide restricted zones do not interfere with the squeeze deformation. Thus, a squeezable container with the cylindrical body is provided, which can be squeezed similarly from any direction.

The means of carrying out the invention of claim 16 comprises that, in the invention of claim 10, 11, 12, 13, 14, or 15, the body has a circular or elliptical cross-section and that the width of the restricted zone is set at (¼)(L-2D1) wherein L is the peripheral length of the cross-section; and D1 is the length of the long axis of the elliptical cross-section.

If the width of the restricted zone were set at a large value, there would be little deformable portion under the condition that a good amount of the content still remained, because of a limitation on the length of the deformable inner layers in the circumferential direction. Under this condition, the content can be hardly discharged when the outer container is squeezed with a hand.

If the restricted zone were set so as to have a narrow width, the deformable inner layers would have too sufficient a length. Even if a good amount of content still remains in the entire inner container, there is a fear that the cross-sectional shape of the inner container may cause the flow path to be almost blocked at a place where the content tends to get smaller, depending on the condition of discharge from the vessel or on the condition of storage. In this state, smooth discharge of the content is no longer possible.

In the case of a circular body, the long axis of an ellipse corresponds to the diameter of the circle. In the case of an elliptical body, the parting line is usually placed in the direction of the long axis, giving consideration to the squeezability of the body when it is held with a hand. The restricted zones are thus located on or near these parting lines. If, in the configuration of claim 16, the width of the restricted zones is set at (¼)(L-2D1), the length of each deformable inner layer in the circumferential direction turns out to be equivalent to the length of contact between the two opposite inner layers, which length is enough to flatten the inner container because of the deflationary deformation that has proceeded with the decrease in the content. In other words, with the progress of ideal deformation over the entire height of the body, the cross-section of the body would become almost flat over the entire height just when most of the content has been discharged. Thus, it is possible to maintain favorable discharging ability and squeeze operability to the last moment of discharge.

The invention of claim 17 includes the configuration of the invention of claims 1, 2, 3, 4, 5, 6, 7, 8, 9, 10, 11, 12, 13, 14, 15, and 16, and in addition, comprises that the air introduction ports are provided in the neck portions of the outer layers.

In the invention of claim 17, the air introduction ports are provided at the neck, which is covered by a cap. These ports therefore do not spoil the container appearance. When the ports are cut off in the after processing, the ports can be drilled easily without piercing the inner bag, because the inner layer is considerably thick at the neck portion.

BRIEF DESCRIPTIONS OF THE INVENTION

Figure 1:
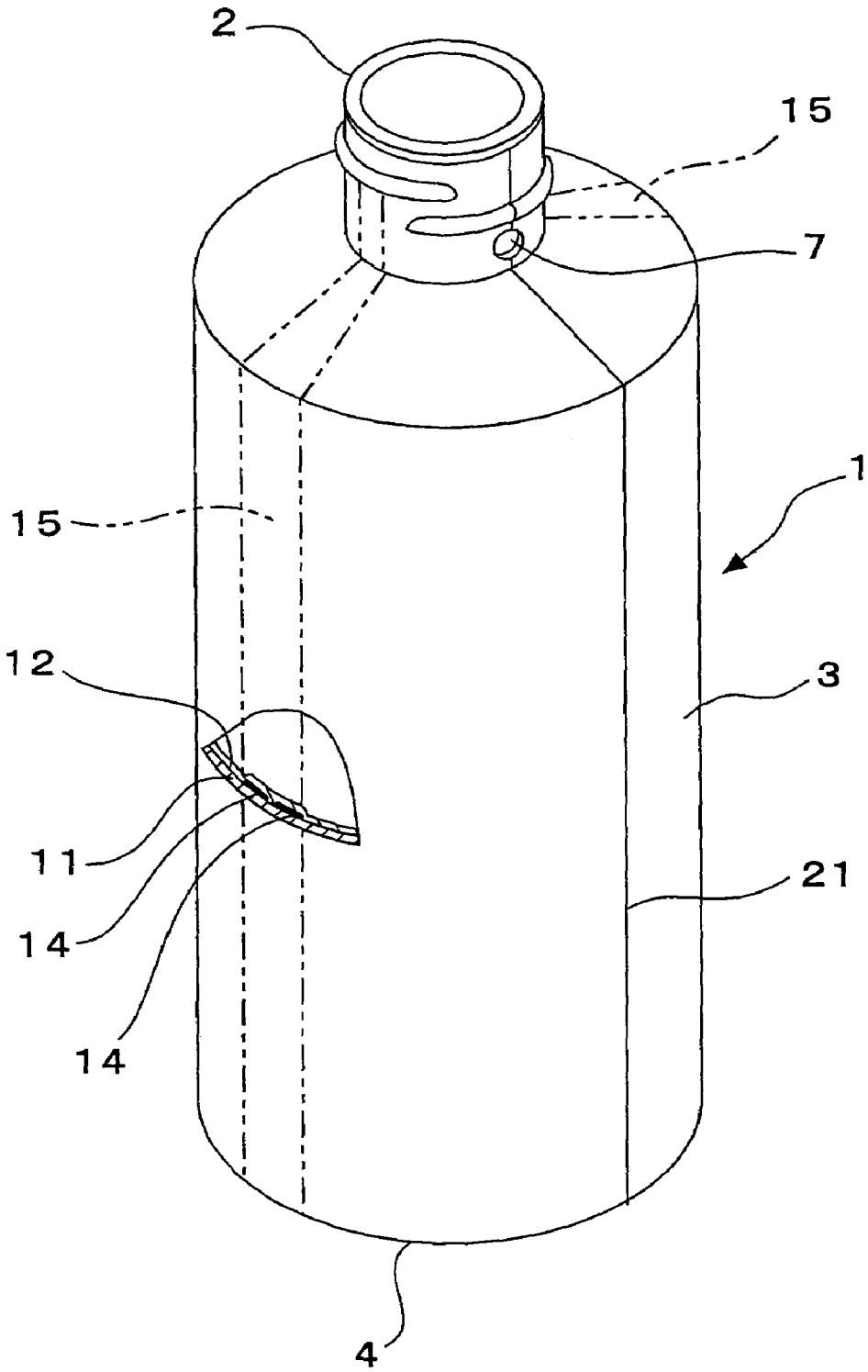
FIG. 1 is an overall perspective view with a partial insection showing the container in the first embodiment of this invention.
Figure 2:
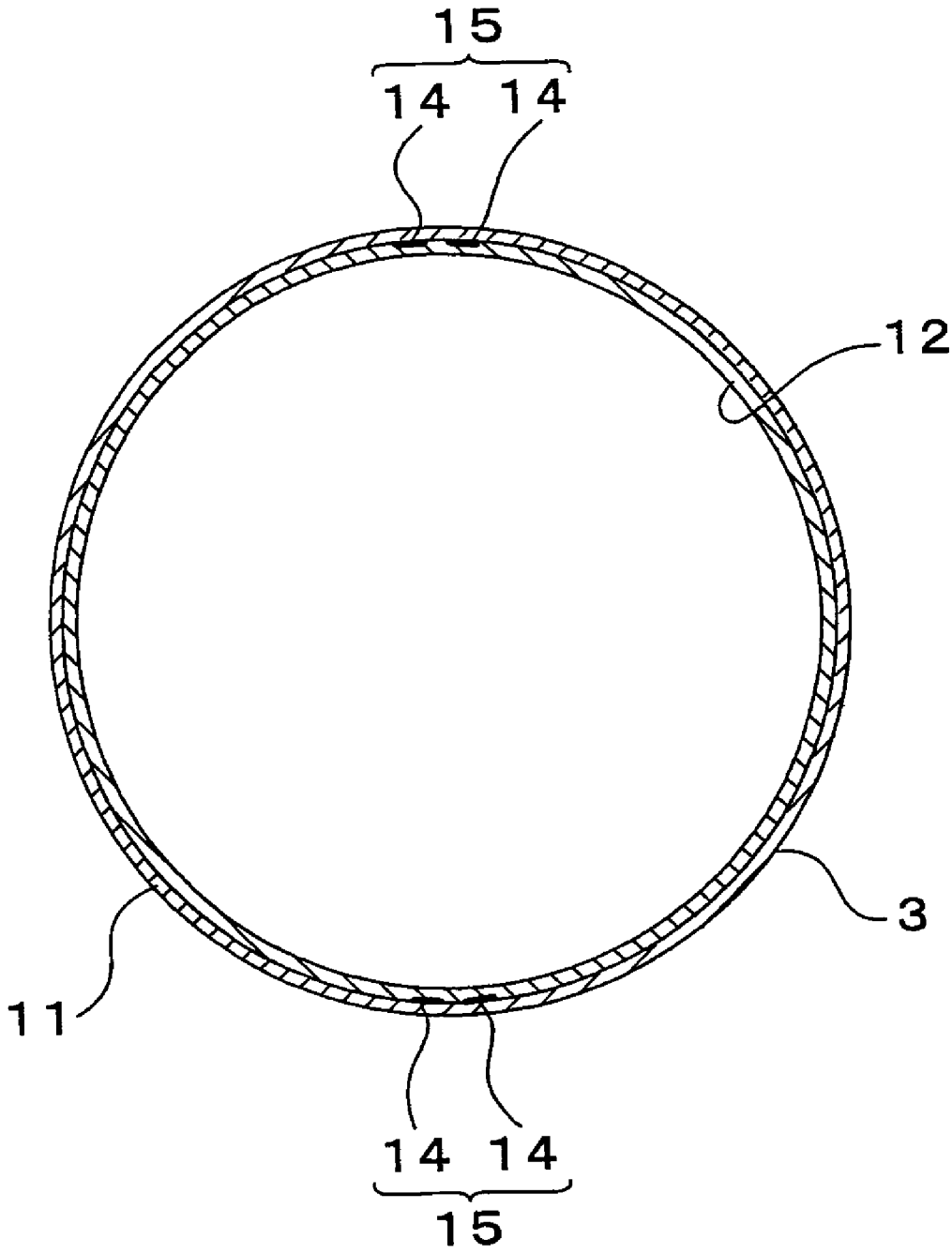
FIG. 2 is a cross-sectional plan view of the embodiment shown in FIG. 1.

FIGS. 24*a* and *b* are explanatory drawings that show the arrangement of the adhered zones on the parison and under the condition that the parison has been pinched off.

PREFERRED EMBODIMENTS OF THE INVENTION

This invention is further described with respect to preferred embodiments, now referring to the drawings.

FIGS. 1–5 show the basic configuration of a blow-molded container in the first embodiment according to this invention. The container 1 is the blow-molded container comprising an outer layer 11 of a synthetic resin, such as polyethylene and polypropylene, which forms an outer shell having a necessary ability to maintain the shape of its own; an inner layer 12, which is molded into a flexibly deformable bag and is made of such a resin as nylon, ethylene-vinyl-alcohol copolymer, and polyethylene terephthalate, having no compatibility with the material of the outer layer 11; and the adhered zones 14 of the vertical strip type, which are disposed over the entire height of the container 1 and are made of an adhesive resin material that has full adhesiveness with both of the outer layer 11 and the inner layer 12. And a pair of restricted zones 15, each comprising a pair of or single adhered zones 14, is formed in the front and the rear of the container 1.

This container 1 has a cylindrical body 3. The neck 2 is disposed standing from the upper end of the body 3, and has screw thread notched around the outer surface of this neck 2. The neck 2 is provided with a pair of air introduction ports 7, which is disposed at two points on the right and left sides, so as to introduce air into the void between the outer layer 11 and the inner layer 12. Both restricted zones 15 are dislocated from the positions of the air introduction ports 7 by a central angle of about 90 degrees. At the lower end of the body 3 there is bottom 4 having an upward arched bottom wall.

Figure 3:
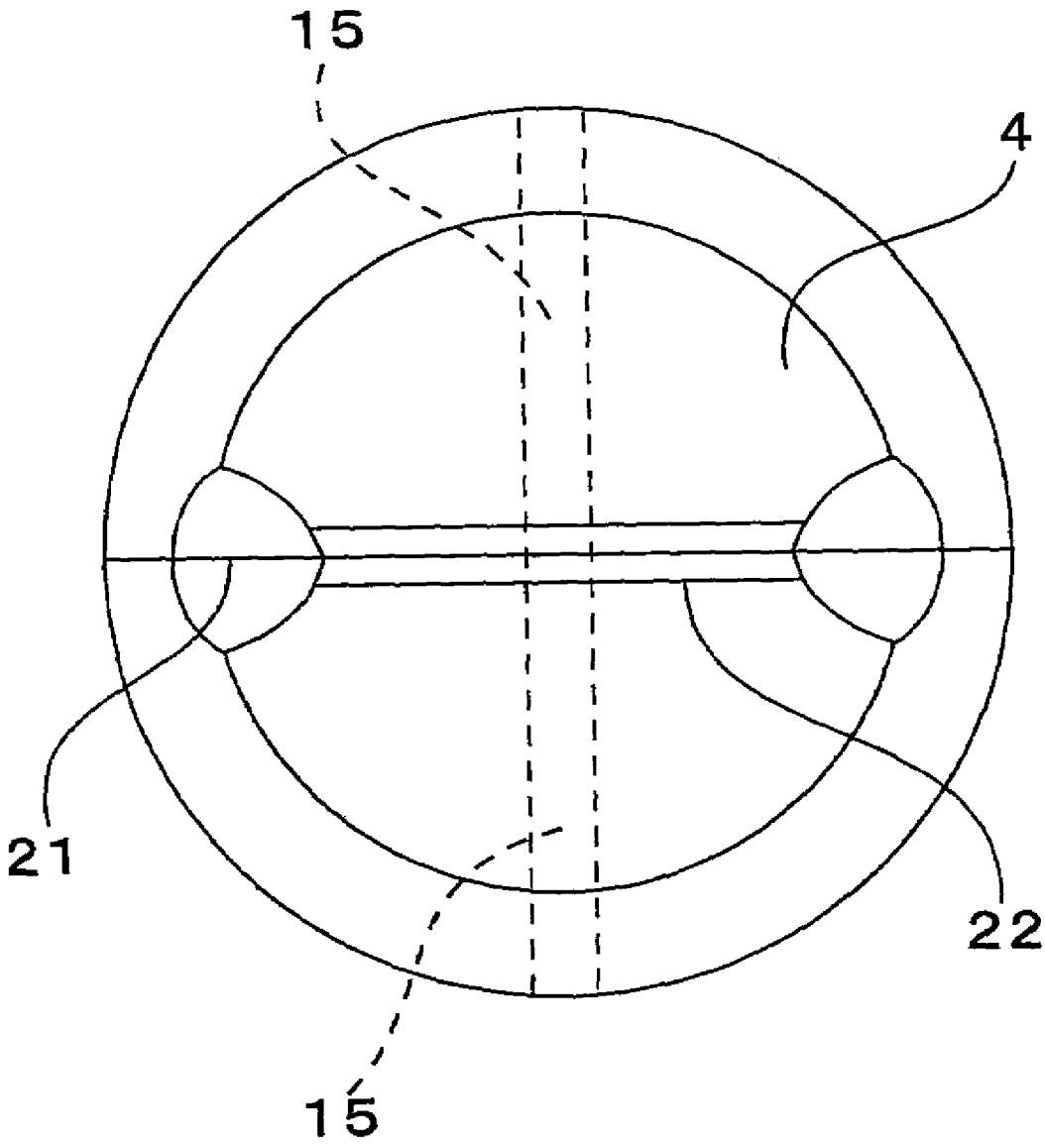
FIG. 3 is a bottom plan view of the embodiment shown in FIG. 1.
Figure 4:
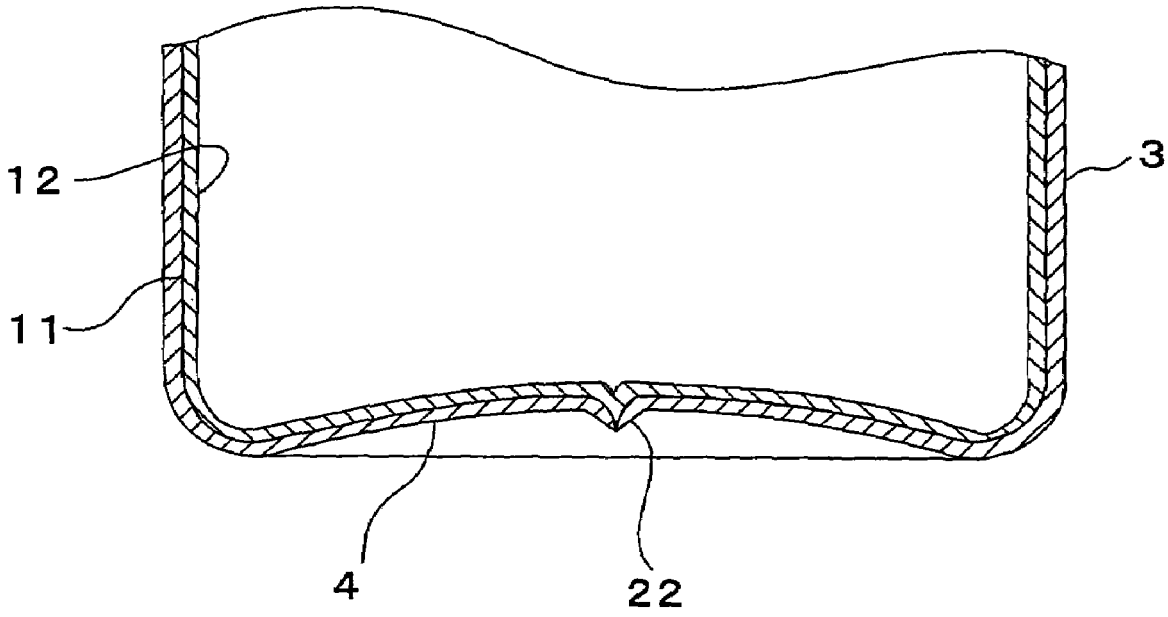
FIG. 4 is an enlarged longitudinal section of the bottom portion in the embodiment shown in FIG. 1.
Figure 5:
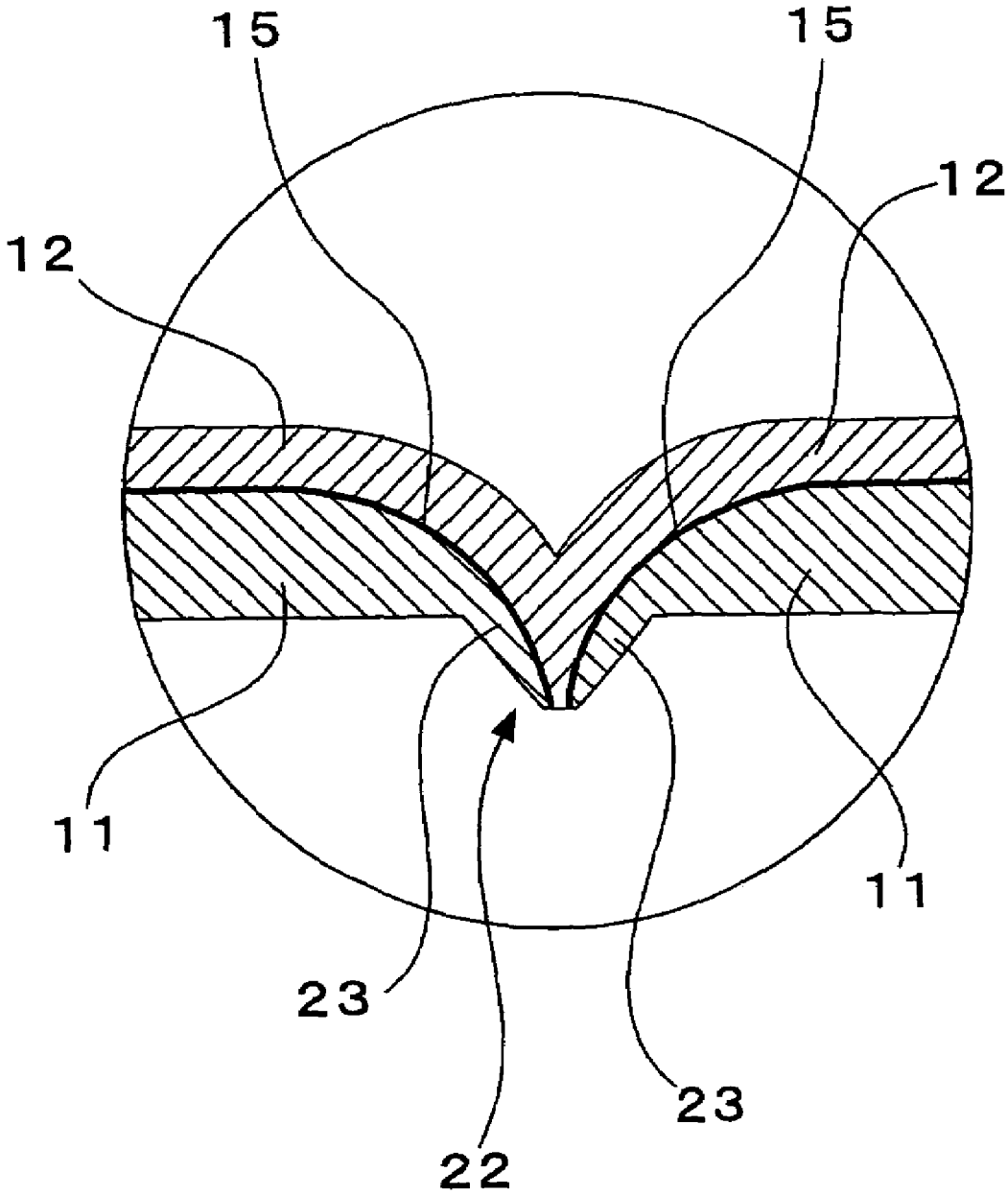
FIG. 5 is an enlarged view of the bottom seal of FIG. 4.

As seen in FIGS. 3, 4, and 5, the bottom 4 has foot function for the container 1 on the periphery of the bottom wall. Bottom seal 22 is provided on the parting line 21 in the central part of the bottom wall, roughly crossing the bottom wall. The bottom seal 22 is formed into a pair of overlaid ribs 23 when the bottom portion of the parison was pinched off with the pinch-off of a split blow mold.

Parison is obtained by extruding together the outer-layer parison to make the outer layer 11, the inner-layer parison located inside the outer cylinder to make the inner layer 12, and adhered zones 14 of the vertical strip strip type, with all strips being sandwiched between the outer parison and the inner parison. The extruded parison is then blow-molded into the container 1 having a pair of restricted zones 15 of the vertical broad strip type positioned axisymmetrically on the central axis, by using a split mold for blow molding.

When the container 1 is blow-molded, the parison is set in the split blow mold at such a posture that a pair of restricted zones 15 is put in the mold clamping direction as taken from the central axis of the parison. As shown in FIG. 3, both restricted zones 15 reach the bottom seal 22 located on the parting line 21 of the bottom 4. Thus, as shown in FIGS. 4 and 5, the restricted zones 15 strongly adhere and fix the outer layer 11 and the inner layer 12 to each other to form a ridge of both ribs 23 in the central part of the pinched bottom seal 22, where the restricted zones 15 are located.

Figure 6:
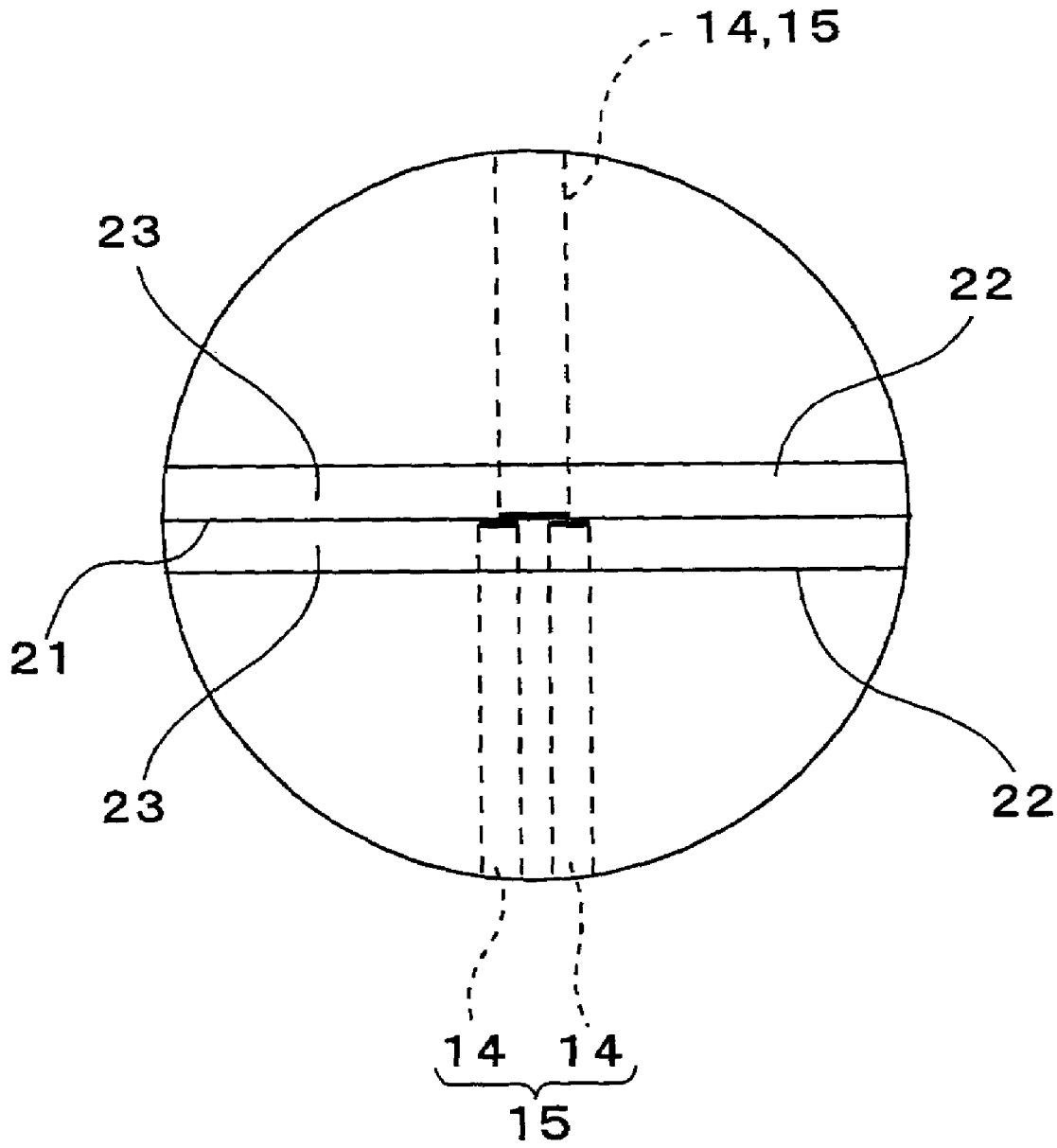
FIG. 6 is an enlarged bottom plan view showing an example of a combination of both restricted zones in the first embodiment of this invention.

FIG. 6 shows an example of a combination of both restricted zones 15 in the first embodiment. One of the restricted zones 15 comprises an adhered zone 14 of the vertical broad strip type; and the other restricted zone 15 comprises two adhered zones 14. The adhered zone 14 of one restricted zone 15 has both corners of its lower end overlapped partly with both adhered zones 14 of the other restricted zone 15 in the end-to-end facing relationship.

At the bottom seal, therefore, the lower ends of both restricted zones 15 strongly adhere and fix the outer layers 11 to each other in their end-to-end facing relationship, and in that state, maintain the stable bonding of the outer layer 11 and the inner layer 12 over the entire width of the other restricted zone 15.

Figure 7:
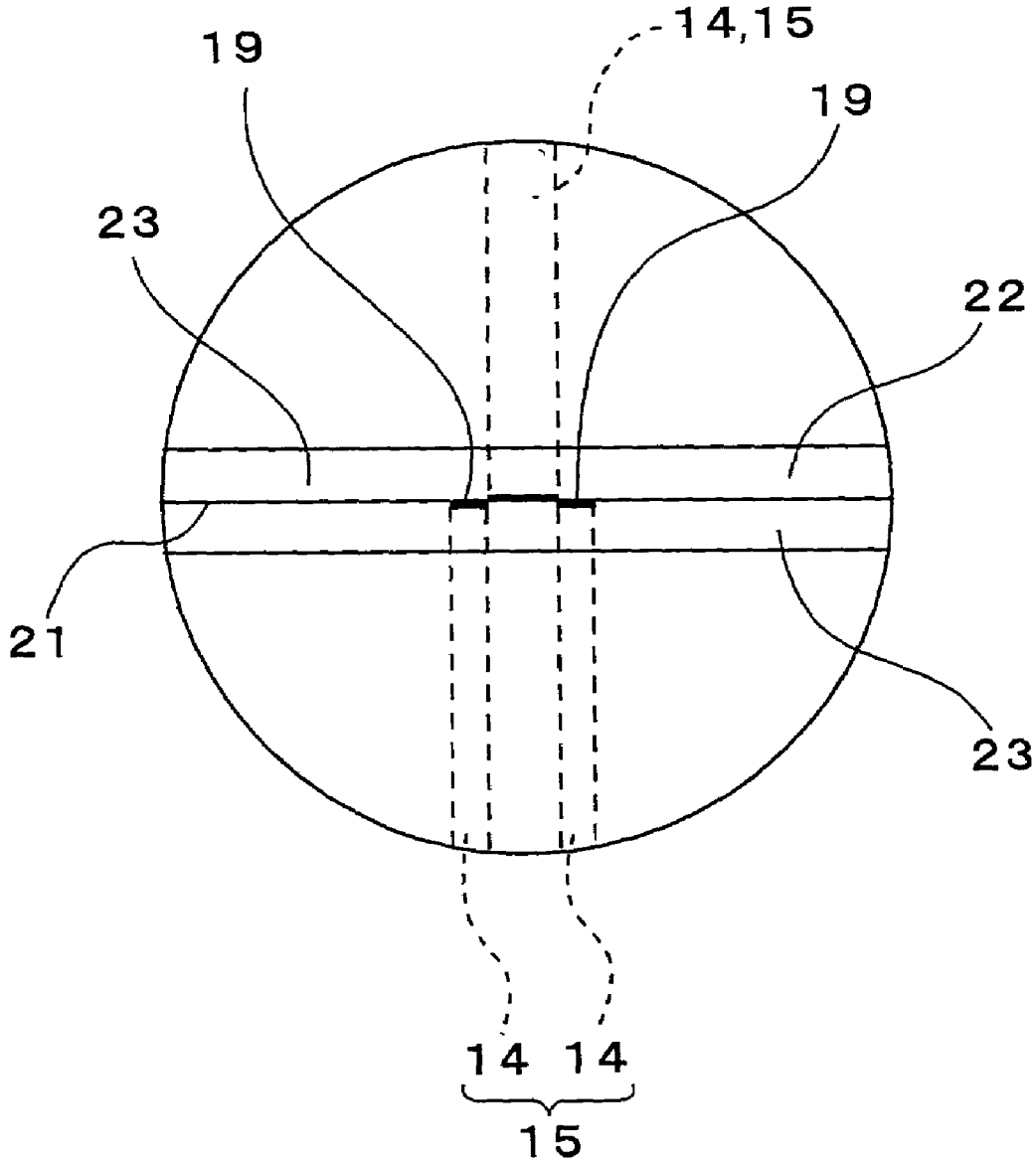
FIG. 7 is an enlarged bottom plan view showing another example of a combination of both restricted zones in the first embodiment of this invention.

FIG. 7 shows an example of a combination of both restricted zones 15 in the first embodiment. The restricted zones 15 in the embodiment shown in FIG. 6 are provided with inner-layer portions 19, which are located on the bottom seal 22 at positions in which these portions are free from flexible deformation, between the lower end of the adhered zone 14 of one restricted zone 15 and the lower ends of the adhered zones 14 of the other restricted zone 15.

Since these inner-layer portions 19 free from flexible deformation are located on the bottom seal 22 from side to side across all the adhered zones 14, the non-deformable inner-layer portions 19 almost integrally connect both of the ribs 23 to each other, under the circumstances that the outer layers 11 and the inner layers 12 are adhered and fixed by the adhered zones 14. This configuration enables the bottom seal 22 to be prevented from randomly occurring flexible deformation over a larger range than the width of the other restricted zone 15.

In the case of the embodiment shown in FIG. 7, both restricted zones 15 are not directly bonded by way of the firmly welded inner layers 12 as in the embodiment shown in FIG. 6, but are connected to each other by way of the inner layers 12 that are not flexibly deformed. Although the strength of adhesive bonding between both restricted zones 15 is lower than in the embodiment shown in FIG. 6, the embodiment of FIG. 7 gives a wider range of bonding over which the outer and inner layers are free from flexible deformation that occurs at random.

Figure 8:
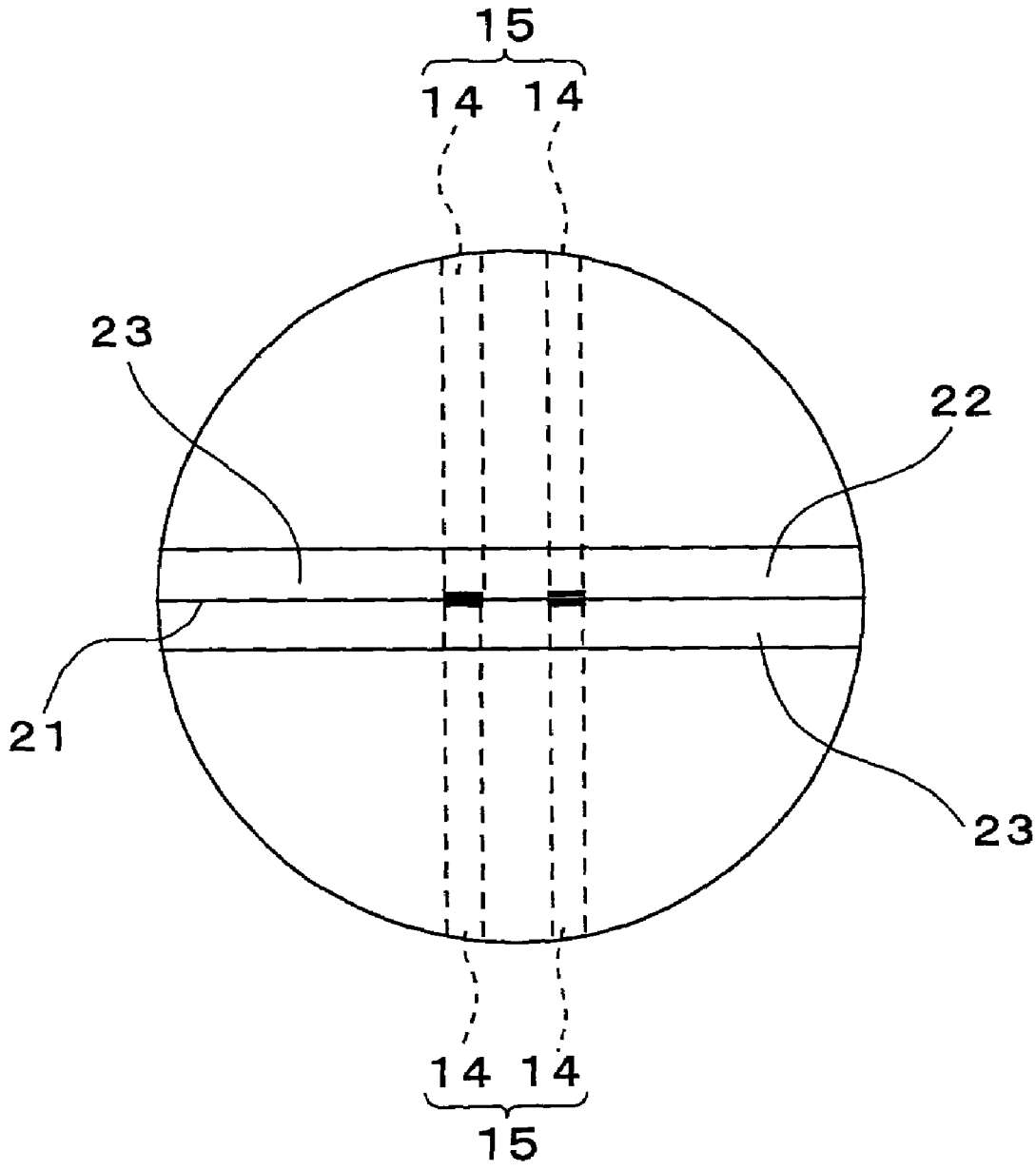
FIG. 8 is an enlarged bottom plan view showing still another example of a combination of both restricted zones in the first embodiment of this invention.
Figure 9:
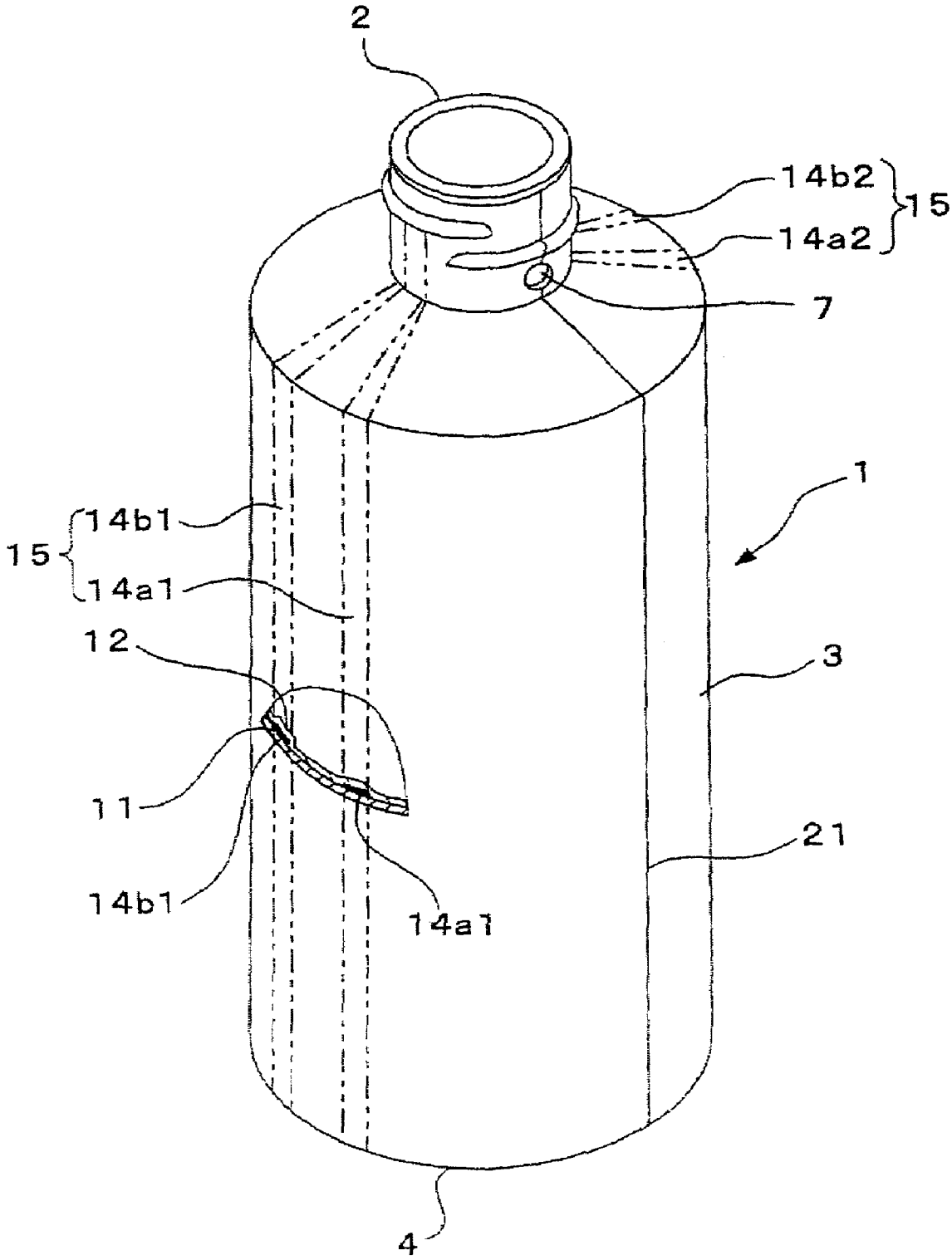
FIG. 9 is an overall perspective view with a partial insection showing the container in the second embodiment of this invention.

FIG. 8 shows still another example of the combination of both restricted zones 15 in the first embodiment. In this case, the restricted zones 15 comprise two each of the adhered zones 14, which have the same width and are disposed at the same spacing. The lower end of each adhered zone 14 is in the wholly end-to-end position, facing the corresponding lower end of the opposite adhered zone 14. Because of this configuration, the bonding between two opposite adhered zones 14 is quite strong. The bonding at the bottom seal between the outer layer 11 and the inner layer 12 is achieved and maintained at the strongest level.

In order for the inner layers to be deflated and deformed smoothly and efficiently, it is advantageous for the air introduction ports 7 to be in positions on the parting line 21 where these ports 7 are equidistant from both restricted zones 15 along the circumferential direction.

In the examples shown in FIGS. 6 and 7, one restricted zone 15 comprises a single adhered zone 14, and the other restricted zone 15 comprises two adhered zones 14. However, the number of adhered zones 14 belonging to a restricted zone 15 is not limited to one or two, but any suitable number can be set according to need. This applies also to the example shown in FIG. 8.

In the configuration of this invention, at least one of the restricted zones 15 comprises two or more adhered zones 14 of the vertical strip type. This is because the action and effect of this invention can be demonstrated even in the configuration that only one restricted zone 15 has two or more adhered zones 14. As shown in examples of the combinations of both restricted zones (FIGS. 6–8), both restricted zones 15 may have two or more adhered zones 14, or only one restricted zone 15 may have two or more adhered zone 14, depending on the purpose of container utilization.

In the foregoing embodiments, the container 1 has been described as having a two-layer structure consisting of the outer layer 11 and the inner layer 12. However, the inner layer 12 of the container 1 of this invention is not limited to a single-layer structure, but is fully acceptable as having a laminated structure. For instance, the two inner layers may comprise an outside synthetic resin layer that can be peeled from the outer layer 11 and an inside layer of a synthetic resin having high resistance to the liquid content.

FIGS. 9–15 show the container 1 in the second embodiments of this invention. The container 1 is the blow-molded container comprising an outer layer 11 of a synthetic resin, such as polyethylene and polypropylene, which forms an outer shell having a necessary ability to maintain the shape of its own; an inner layer 12, which is molded into a flexibly deformable bag and is made of such a resin as nylon, ethylene-vinyl-alcohol copolymer, and polyethylene terephthalate, having no compatibility with the material of the outer layer 11; and two pairs of or a total of four adhered zones 14 of the vertical strip type, which are disposed over the entire height of the container 1 and are made of an adhesive resin that has full adhesiveness with both of the outer layer 11 and the inner layer 12. And a pair of restricted zones 15 comprising two pairs of adhered zones 14 is formed in the front and the rear of the container 1.

This container 1 has a cylindrical body 3. The neck 2 is disposed at the position standing from the upper end of the body 3, and has screw thread notched around the outer surface of this neck 2. The neck 2 is provided with a pair of air introduction ports 7, which is disposed at two points in the outer layers 11 on the right and left parting lines 21, so as to introduce air into the void between the outer layer 11 and the inner layer 12.

Four adhered zones 14 (14*a*1, 14*a*2, 14*b*1, and 14*b*2) are disposed at positions dislocated from the air introduction ports 7 by a central angle of 90 degrees. Among them, 14*al* and 14*a*2 are axisymmetrical respectively with 14*b*2 and 14*b*1. The entire zone comprises a pair of adhered zones on the same side of the parting line 21 (14*a*1 and 14*b*1 or 14*a*2 and 14*b*2) combined with the middle zone sandwiched between the pair of adhered zones 14 (This entire zone is referred to as the restricted zone 15). The restricted zone 15 is set so as to have a width of (¼)(L-2D), wherein L is the peripheral length of the body circumference; and D is the diameter of the cross-section of the body.

Figure 11:
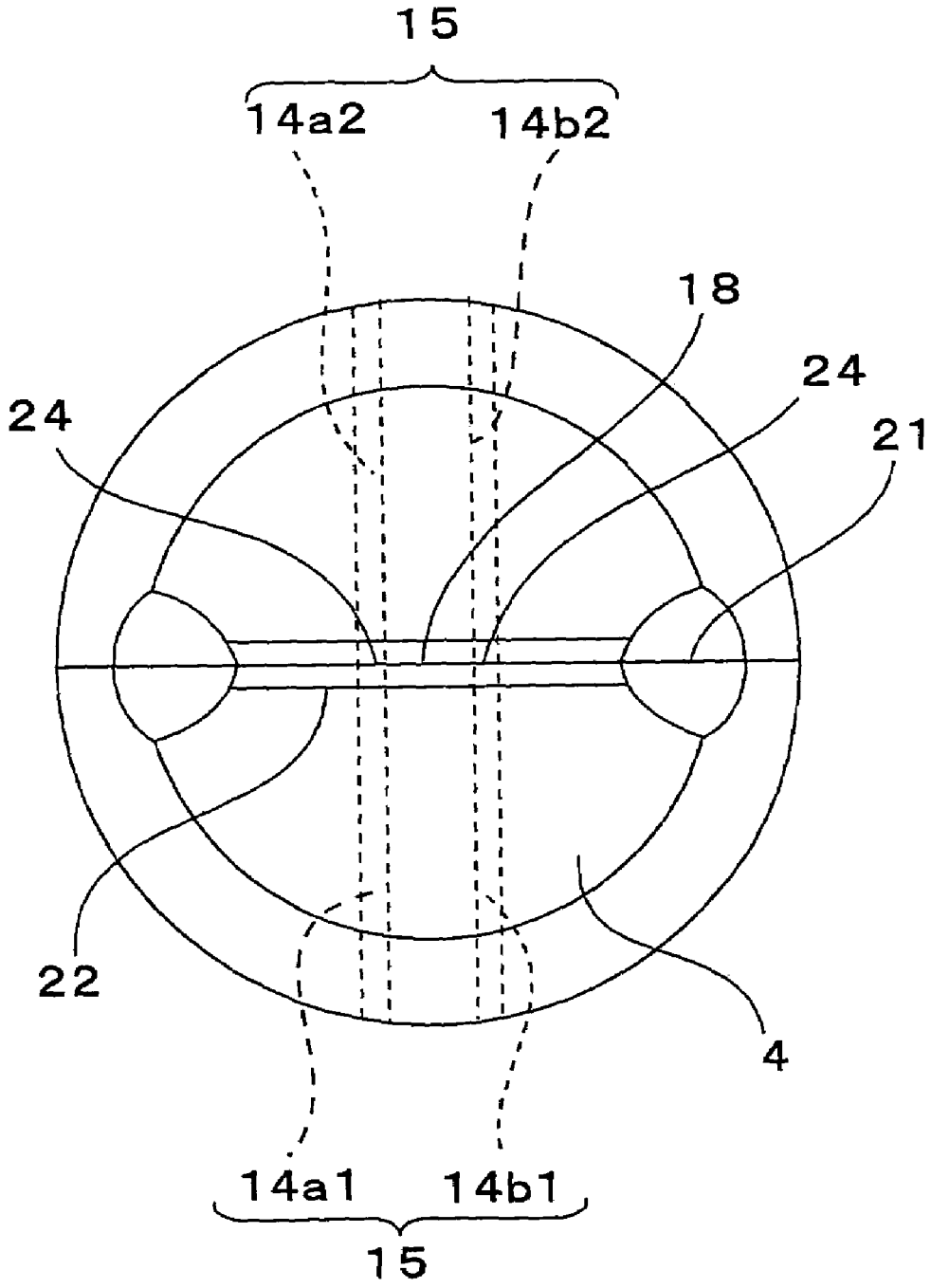
FIG. 11 is a bottom plan view of the embodiment shown in FIG. 9.
Figure 12:
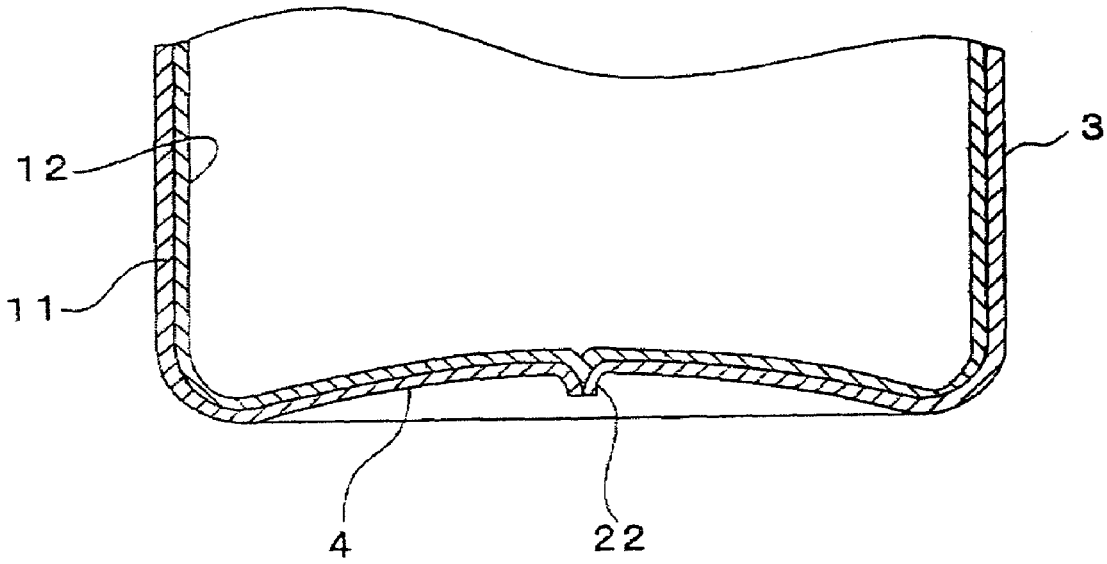
FIG. 12 is an enlarged longitudinal section of the bottom portion in the embodiment shown in FIG. 9.

At the lower end of the body 3 there is the bottom 4 having an upward arched bottom wall. As seen in FIGS. 11 and 12, the bottom 4 has foot of the container 1 on the periphery of the bottom wall. Bottom seal 22 is provided on the parting line 21 in the central part of the bottom wall, roughly crossing the bottom wall. The seal 22 has been formed when the bottom portion was pinched off with the pinch-off of the blow mold.

Parison is obtained by extruding together the outer cylinder to make the outer layer 11, the inner cylinder located inside the outer cylinder to make the inner layer 12, and the adhered zones 14 of the vertical strip type, with all strips being sandwiched between the outer cylinder and the inner cylinder. This parison is then blow-molded into the container 1 having the restricted zones 15 of the vertical broad strip type positioned axisymmetrically on the central axis, by using a split mold for blow molding.

When the container 1 in the second embodiment is blow-molded, the parison is set in the split blow mold at such a posture that two pairs of adhered zones 14 are put in the mold clamping direction taken from the central axis of the parison. As shown in FIG. 11, the adhered zones 14 reach the bottom seal 22 located on the parting line 21 of the bottom 4.

Two each of adhered zones 14, i.e., 14*a*1 and 14*a*2, or 14*b*1 and 14*b*2, are separated by the parting line 21 and are located opposite to each other. Thus, as shown in FIGS. 11 and 12, the lower ends of one pair of adhered zones 14 take the end-to-end positions facing those of the other pair of opposite adhered zones 14 in the central part of the pinched bottom seal 22 (hereinafter the portion in the end-to-end facing relationship between two adhered zones is referred to as the "end-to-end facing portion 24").

Figure 13:
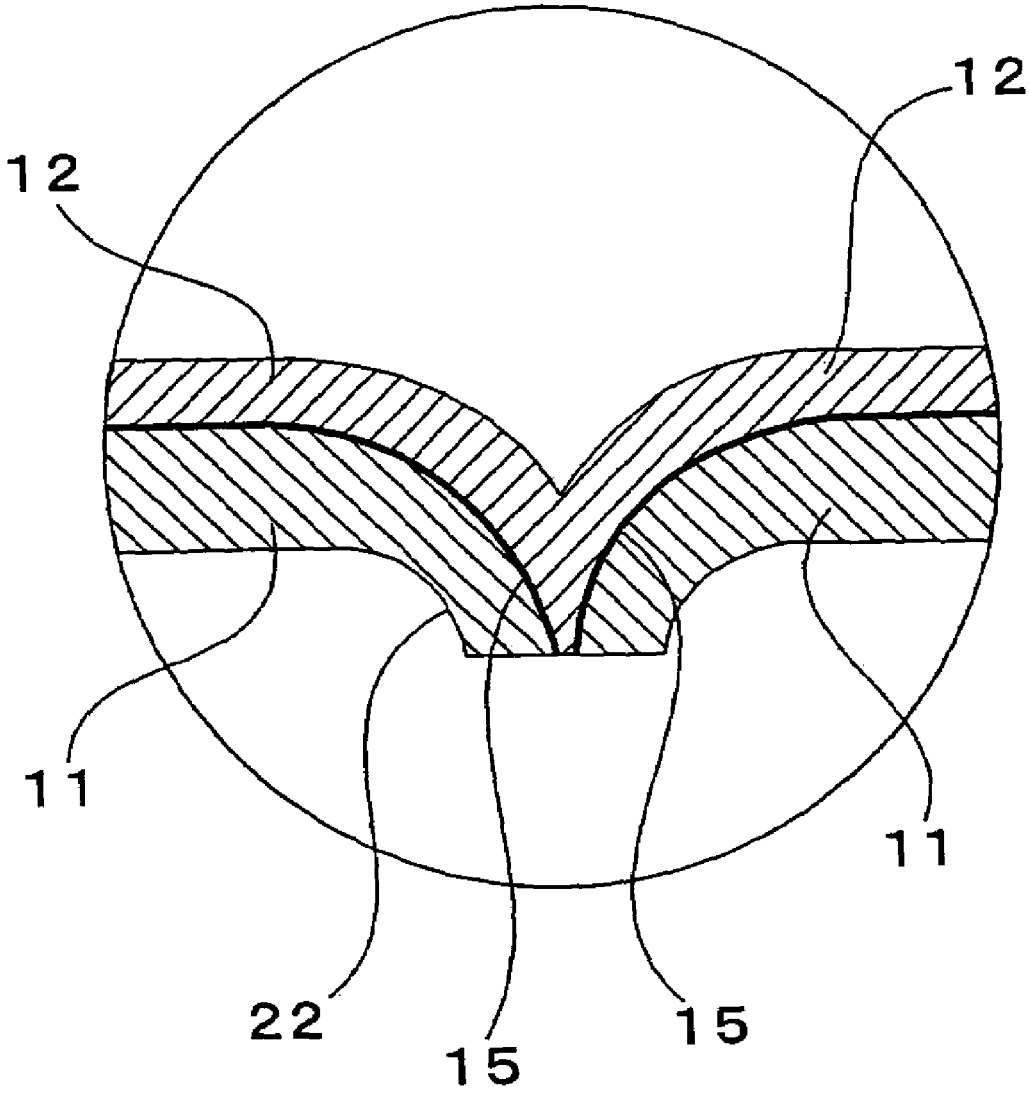
FIG. 13 is an enlarged view of the bottom seal of FIG. 12.
Figure 14:
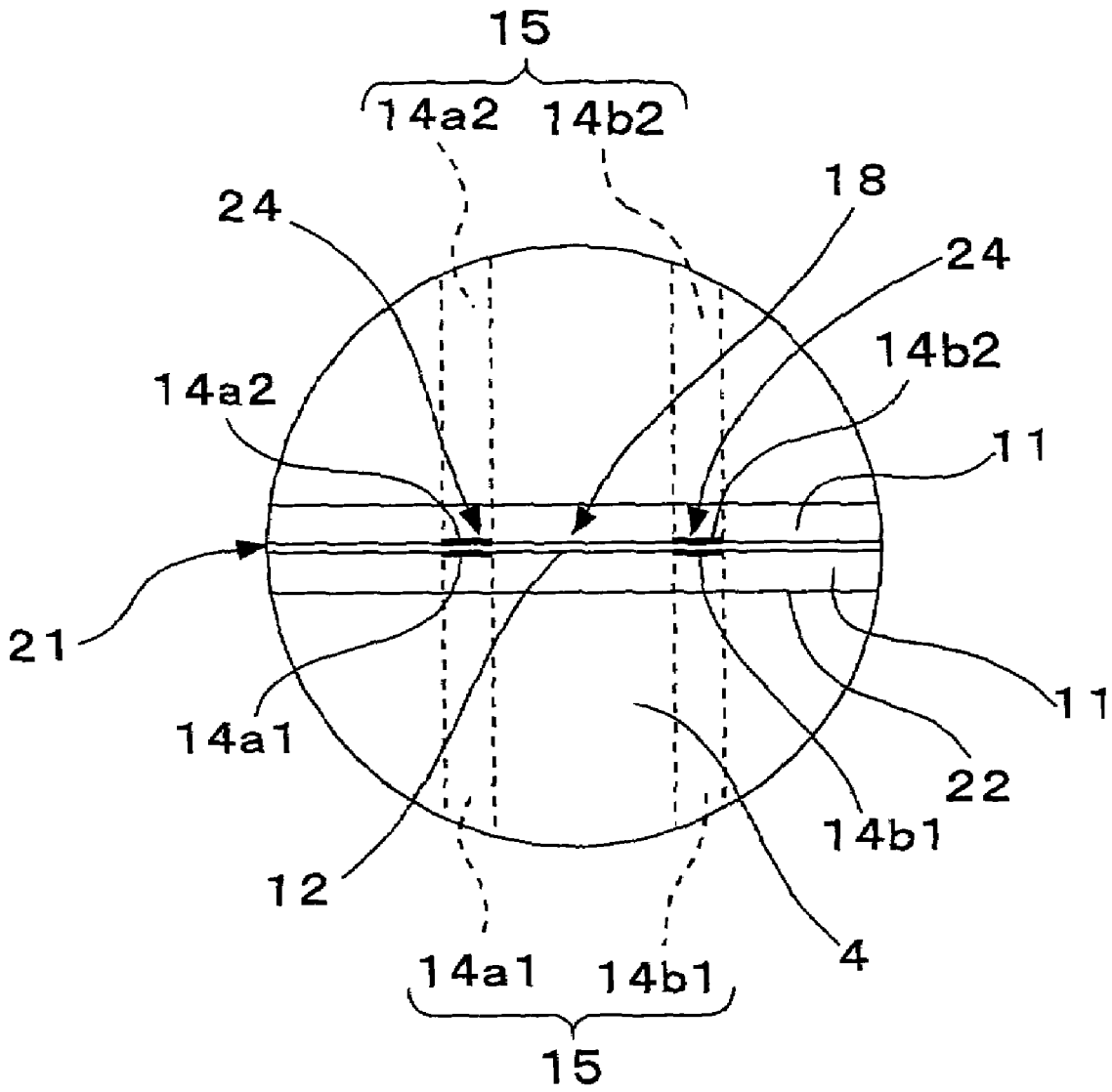
FIG. 14 is an enlarged view of the bottom seal shown in FIG. 11.

Therefore, as shown in FIGS. 13 and 14, the adhered zones 14 strongly adhere and fix the outer layers 11 on both sides of the parting line 21 to the inner layers 12 sandwiched by these outer layers 11, in these end-to-end facing portions 24 on the pinched bottom seal 22. In addition, the middle zone 18 between the two end-to-end facing portions 24 is also fixed by these end-to-end facing portions and serves to restrict individual deformation of the inner layers 12 or the outer layers 11. As a result, strong bonding is achieved between the outer layers 11 and the inner layers 12 over a wide range of the restricted zones 15, including the width of each pair of adhered zones 14 and the width of the middle zone 18.

Figure 10:
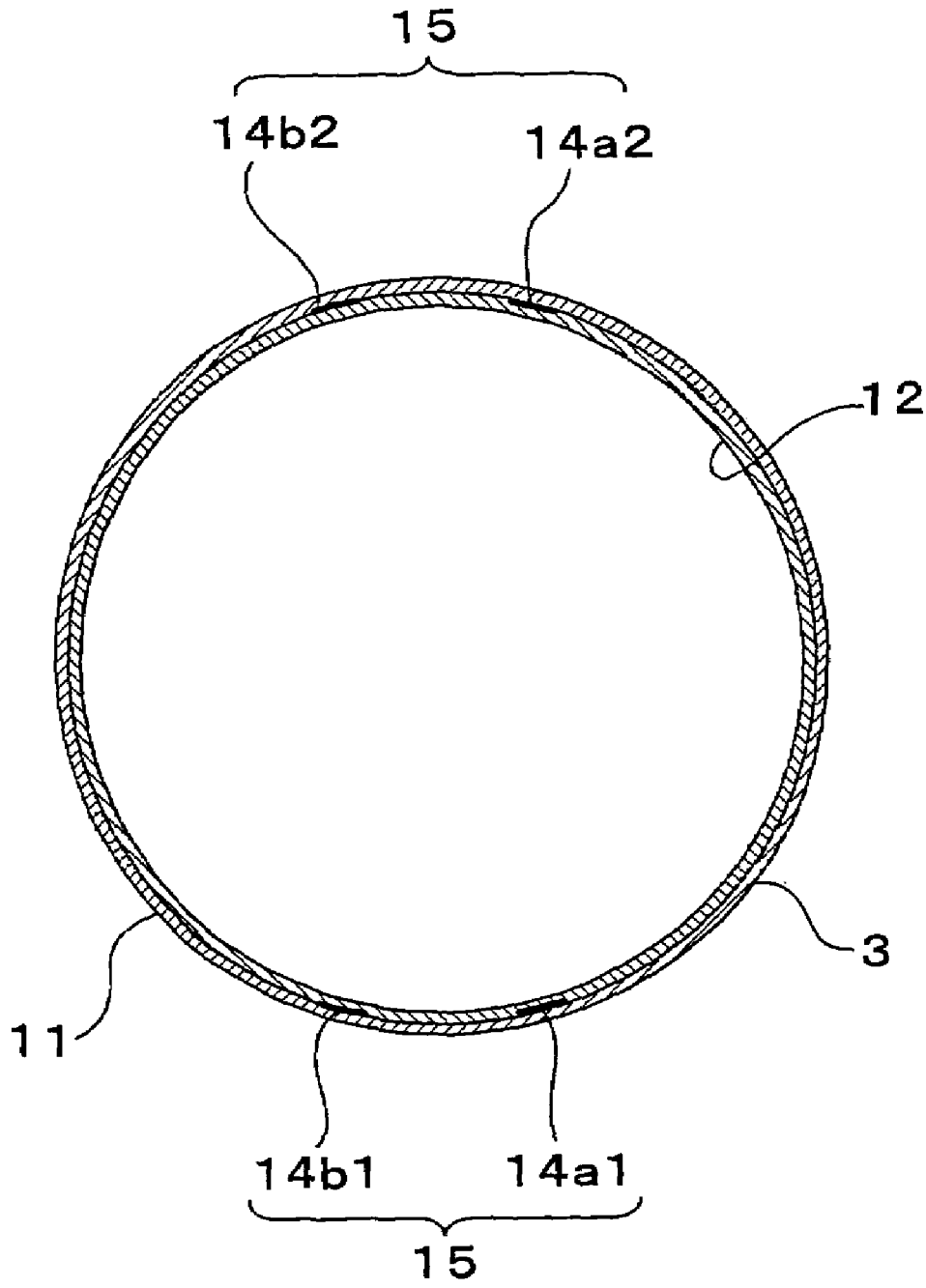
FIG. 10 is a cross-sectional plan view of the embodiment shown in FIG. 9.
Figure 15:
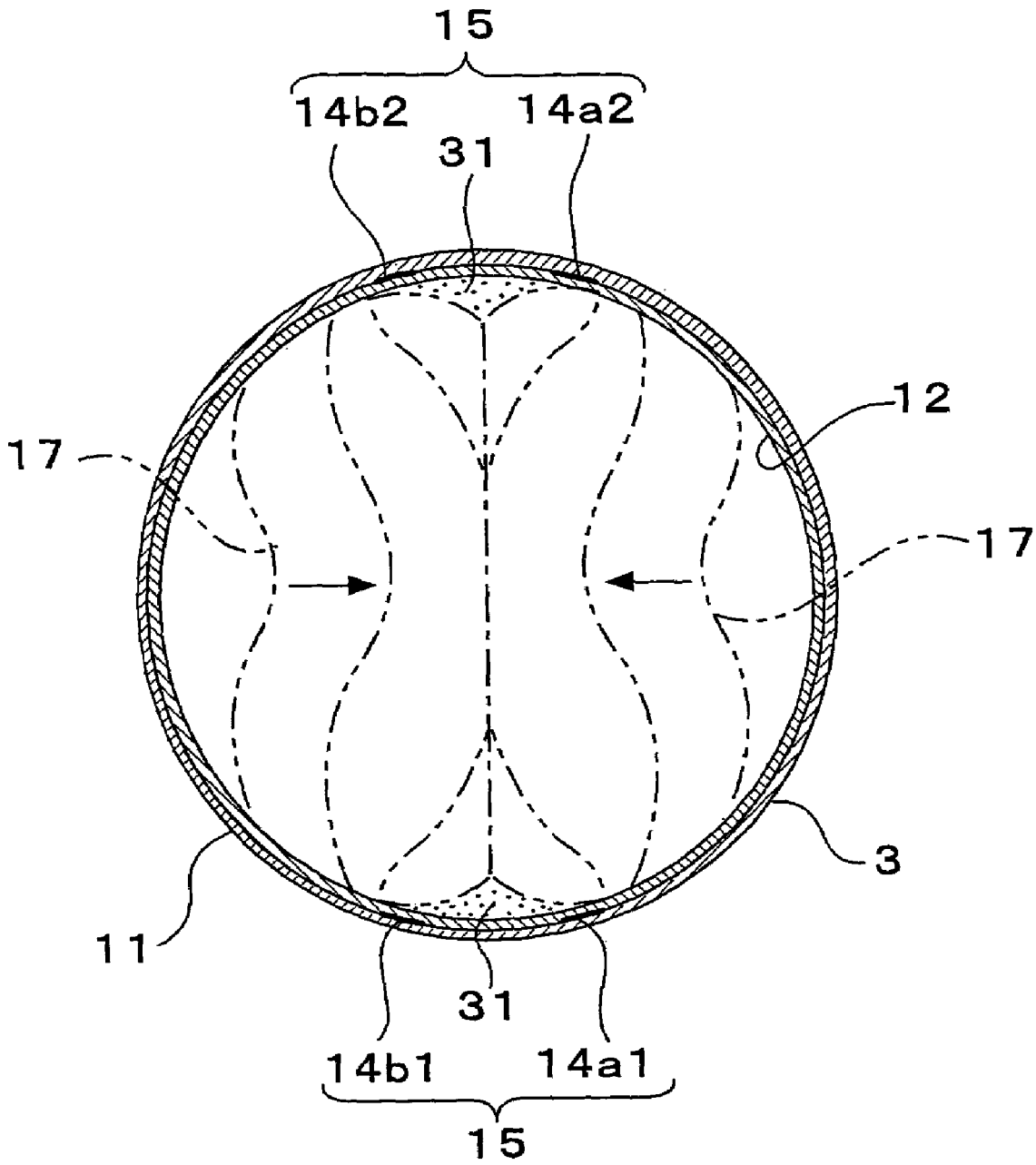
FIG. 15 is the same cross-sectional plan view as FIG. 10, which shows the trend in the deformation of the inner layers.
Figure 16:
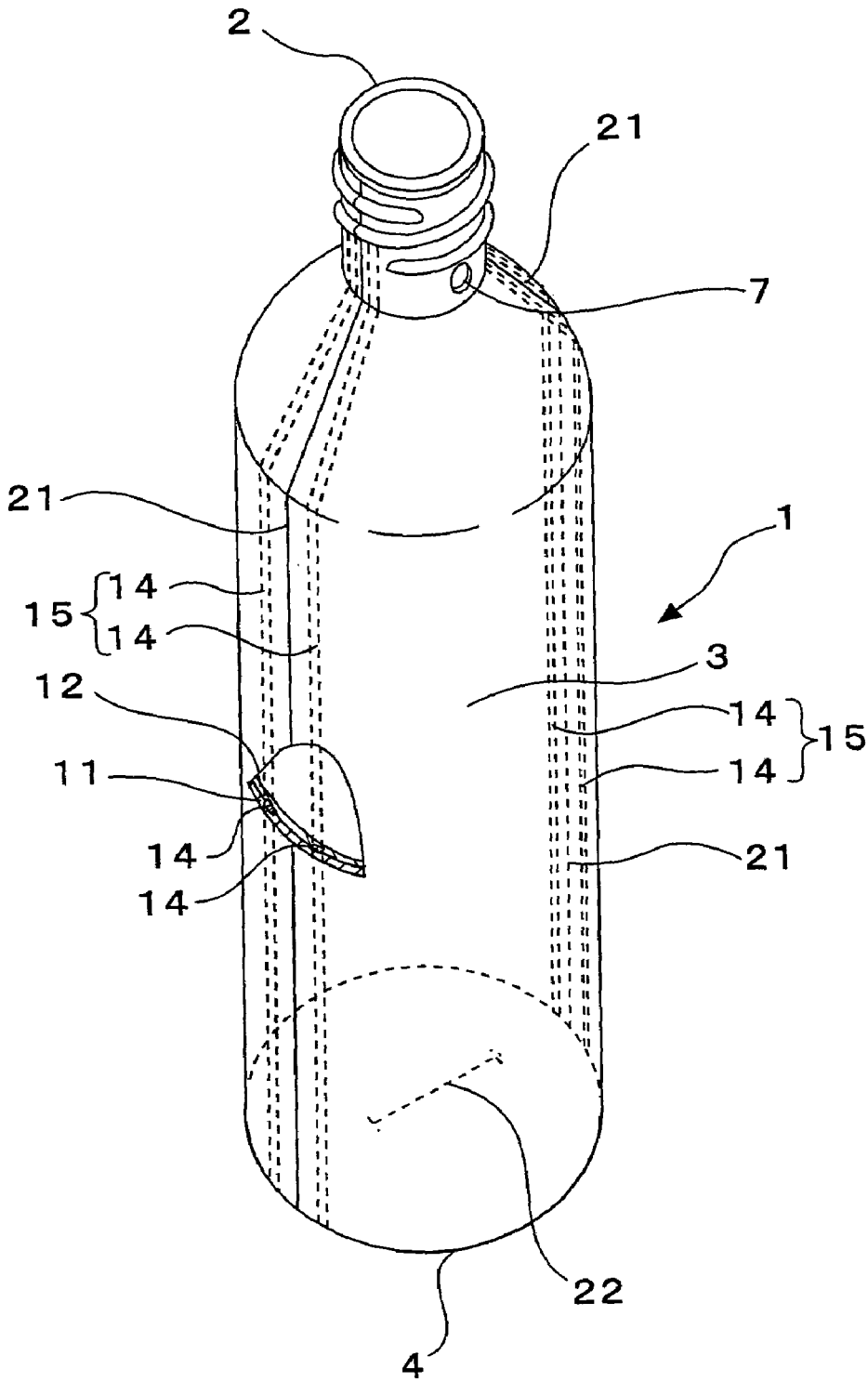
FIG. 16 is an overall perspective view with a partial insection showing the container of the pouring vessel in the third embodiment of this invention.

FIG. 15 is an explanatory drawing, which shows the trend in the deformation of the inner layers in the same cross-sectional plan view as FIG. 10. In this second embodiment, a pair of air introduction ports 7 is disposed at the neck 2, and is located axisymmetrically on the parting line 21. The deflationary deformation of the inner layers 12 is caused by a decrease in the inner pressure or a decrease in the content 15. The deformation proceeds in the two deformable inner layers 17 that are located between the adhered zones 14*a*1 and 14*a*2 and between adhered zones 14*b*1 and 14*b*2. At that time, a pair of restricted zones 15, disposed at positions dislocated from the parting line 21 by a central angle of 90 degrees, performs the function to restrict the deformation.

With the discharge of the content 31 being in progress, the changes in the deformable inner layers 17 on the cross-section of the body 3 go on in the following manner. First of all, the deformable inner layers 17 become dented at their central parts. With the progress of deformation, the defomable inner layers 17 come in contact with each other at the center. Then, this line of contact extends in opposite directions so that the content is squeezed in the circumferential direction and toward the portions where there are the restricted zones 15. Ideally, the deflationary deformation goes on in a symmetrical pattern.

When the content 31 is further discharged with the progress of deflationary deformation, the defomable inner layers 17 becomes almost flat on the cross-section in the state in which little of the content 31 remains in the inner bag. In order for this condition to be achieved at that time, the length of the deformable inner layers 17 can be set at a sum of the diameter, D, of the cross-section of the body 3 and the width of each restricted zone 15. In other words, the restricted zones 15 can be set so as to have a width of (¼)(L-2D). In this way, the content 31 can be used up while securing the content flow path to the last moment.

In the foregoing second embodiment, the container 1 has been described as having a two-layer structure consisting of the outer layer 11 and the inner layer 12. However, the inner layer 12 of this invention is not limited to a single-layer structure, but is fully acceptable as having a laminated structure. For instance, the two inner layers may comprise an outside synthetic resin layer that can be peeled from the outer layer 11 and an inside layer of a synthetic resin having high resistance to the content.

FIGS. 16, 18, 20, and 21 show the container 1 in the third embodiment of this invention. The container 1 comprises an outer layer 11 of a low-density polyethylene resin, an inner layer 12 of a nylon resin that has no compatibility with the low-density polyethylene resin, and adhered zones 14 made of an adhesive resin that is fully adhesive with both of the low-density polyethylene and the nylon.

The bottle-like container 1 comprises the bottom 4, the body 3 having a circular cross-section, and the cylindrical neck 2 disposed on the upper end of the body 3 via shoulder and having screw thread notched around the outer surface of this neck 2.

The container 1 has a height of 160 mm. The body 3 has a circular cross-section and the diameter (bore diameter) of 60 mm.

The outer layer 11 and the inner layer 12, which make up the container 1, are laminated peelably except for the portions adhered and fixed by the adhered zones 14. The outer layer 11 forms the outer container 5 having a sufficient mechanical strength, the deformability to make the container squeezable, and the flexibility to make it recoverable to its original shape. Laid inside the outer container 5, the inner layer 12 forms an inner container 6 that is thin enough to be fully deflated (See FIGS. 16 and 17).

Figure 18:
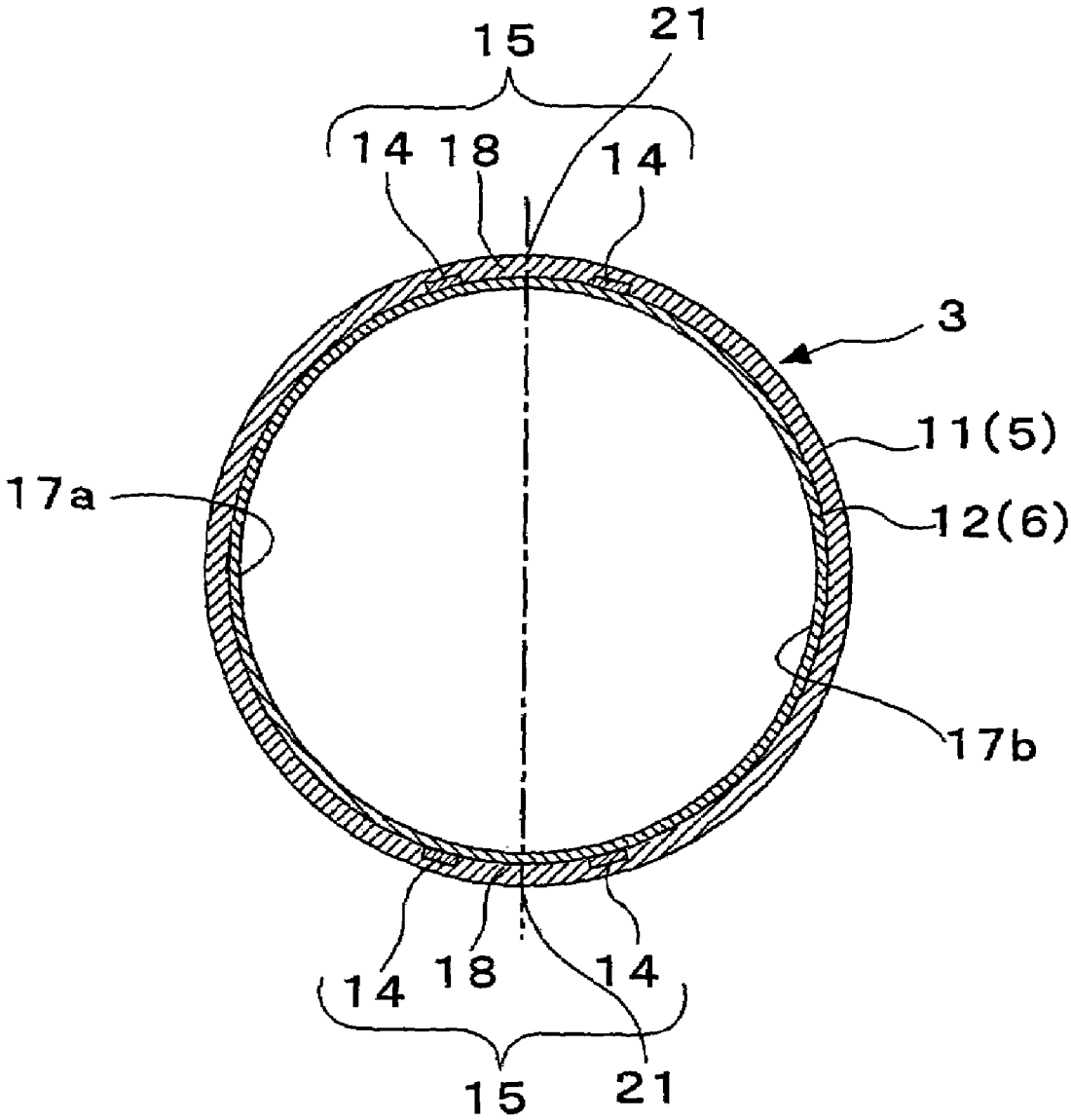
FIG. 18 is a cross-sectional plan view, taken from the line A—A, of the embodiment shown in FIG. 17.

FIG. 18 shows the cross-section of the body 3. A pair of restricted zones 15 is disposed over the roughly entire height of the container 1, at the positions where there are the right and left parting lines 36 (vertically illustrated in FIG. 18) in the circular cross-section of the body 3.

Each restricted zone 15 comprises a pair of adhered zones 14 and the middle zone 18 between these adhered zones 14. The pair of restricted zones 15 restricts the deflationary deformation of the inner container 6, and gives favorable squeeze operability to the container 1.

The restricted zone 15 in this embodiment has a width of 17 mm, as calculated from (¼)(L-2D1), or from (¼)D(π-2) in the case of a circular cross-section, wherein D is the diameter and π is the ratio of the circumference of the circle to its diameter. The adhered zone 14 has a width of 2 mm.

Since the restricted zones 15 are disposed on the parting lines 21, the front and rear portions of the body 3 are provided between the two vertical parting lines 21 and can be made smooth with no irregularity. A label can be attached or printed on the front surface. In addition, since the adhered zones 14 can be narrow, and the restricted zones 15 can be made inconspicuous, there is provided a container having good outer appearance and high value as a commercial product.

Figure 22:
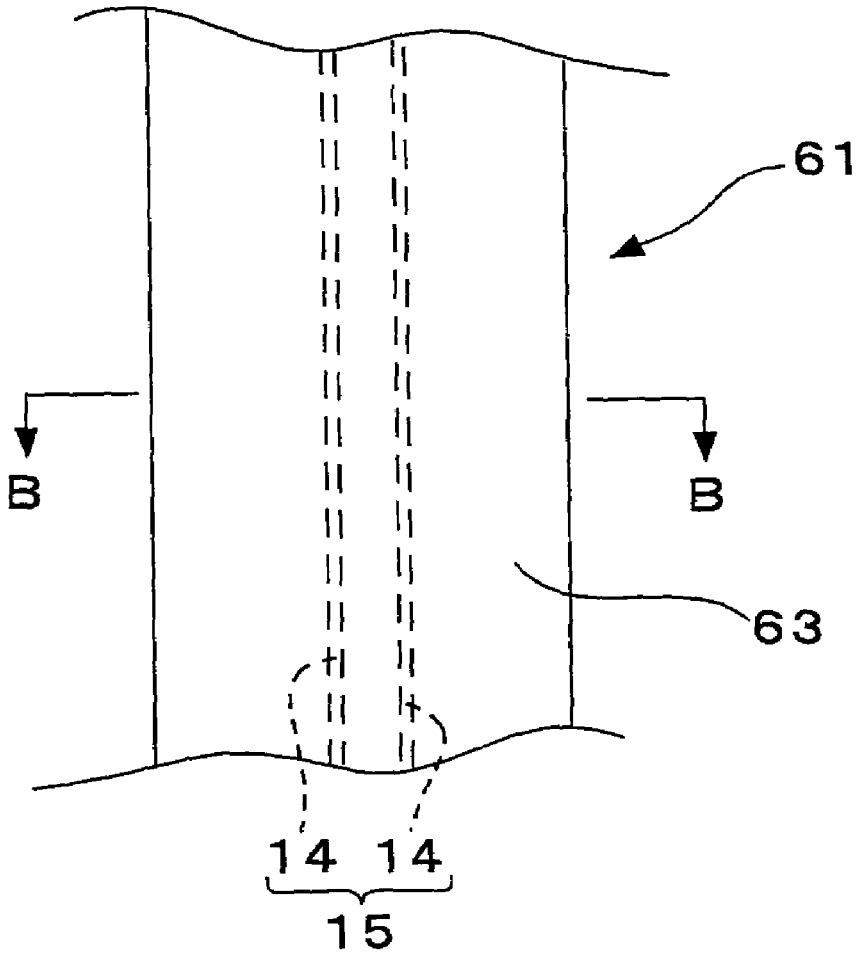
FIG. 22 is a front elevational view showing an example of parison, which is blow-molded into the container of FIG. 16.
Figure 23:
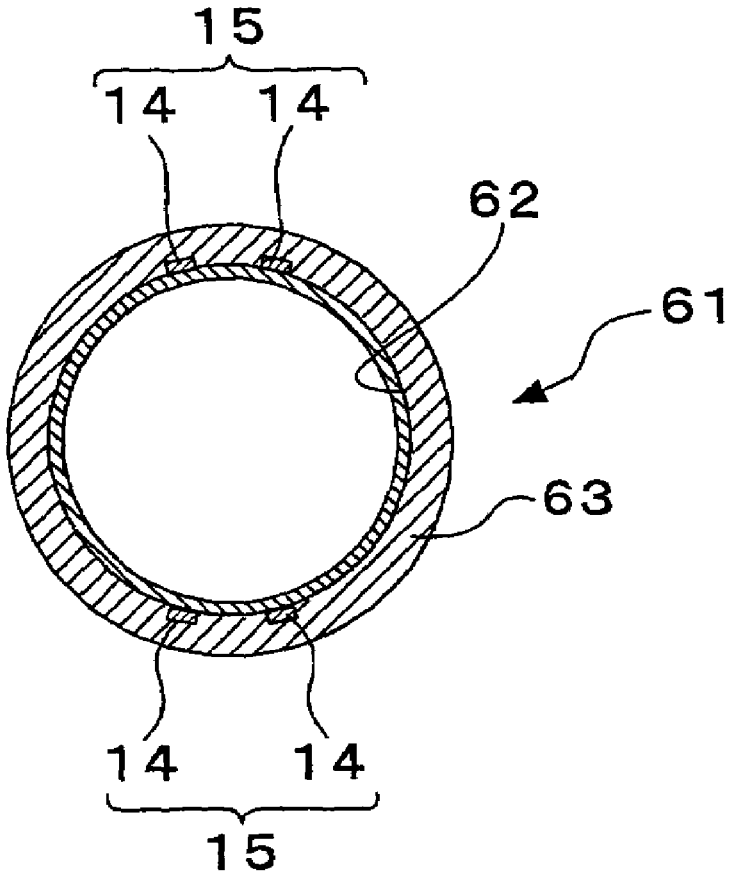
FIG. 23 is a cross-sectional plan view, taken from the line B—B, of the container of FIG. 22.

As shown in FIGS. 22 and 23, parison 61 is first molded by extruding together an outer parison 63, an inner parison 62 located inside the outer parison 63, and two pairs of adhered zones 14 of the vertical strip type positioned axisymmetrically on the central axis, with each strip being sandwiched between the outer parison 62 and the inner parison 63. This parison 61 is then blow-molded into the container 1, by using a split mold for blow molding.

The cylindrical neck 2 has screw thread notched on the outer wall and is provided with a pair of air introduction ports 7. These ports 7 are disposed axisymmetrically on the central axis of the outer container 5 at positions of right angles from the parting lines 21 (See FIG. 16).

Figure 17:
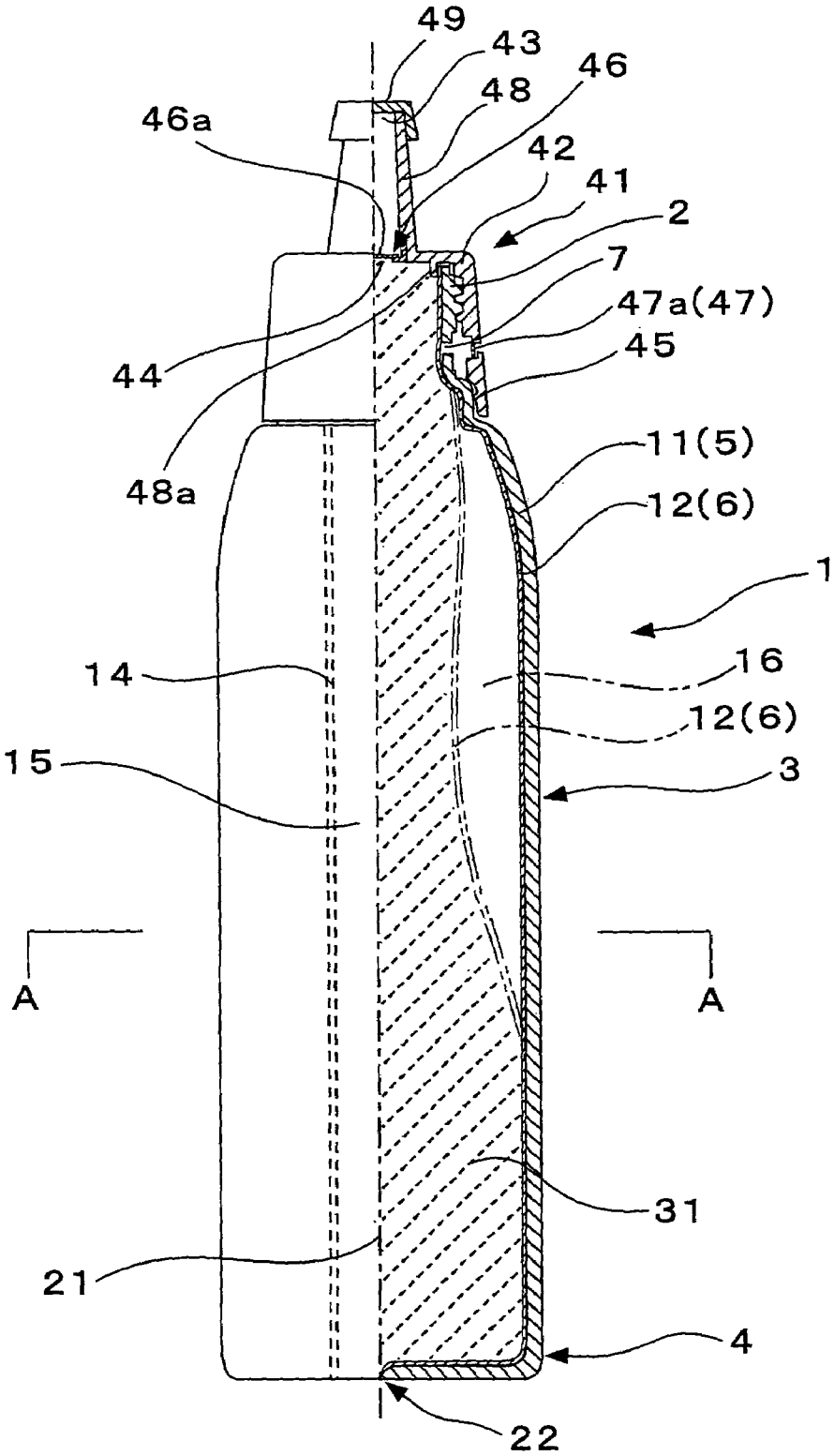
FIG. 17 is a side view showing the attachment of the discharge cap to the container in the third embodiment of this invention, with the right half being illustrated in the longitudinal section.
Figure 19:
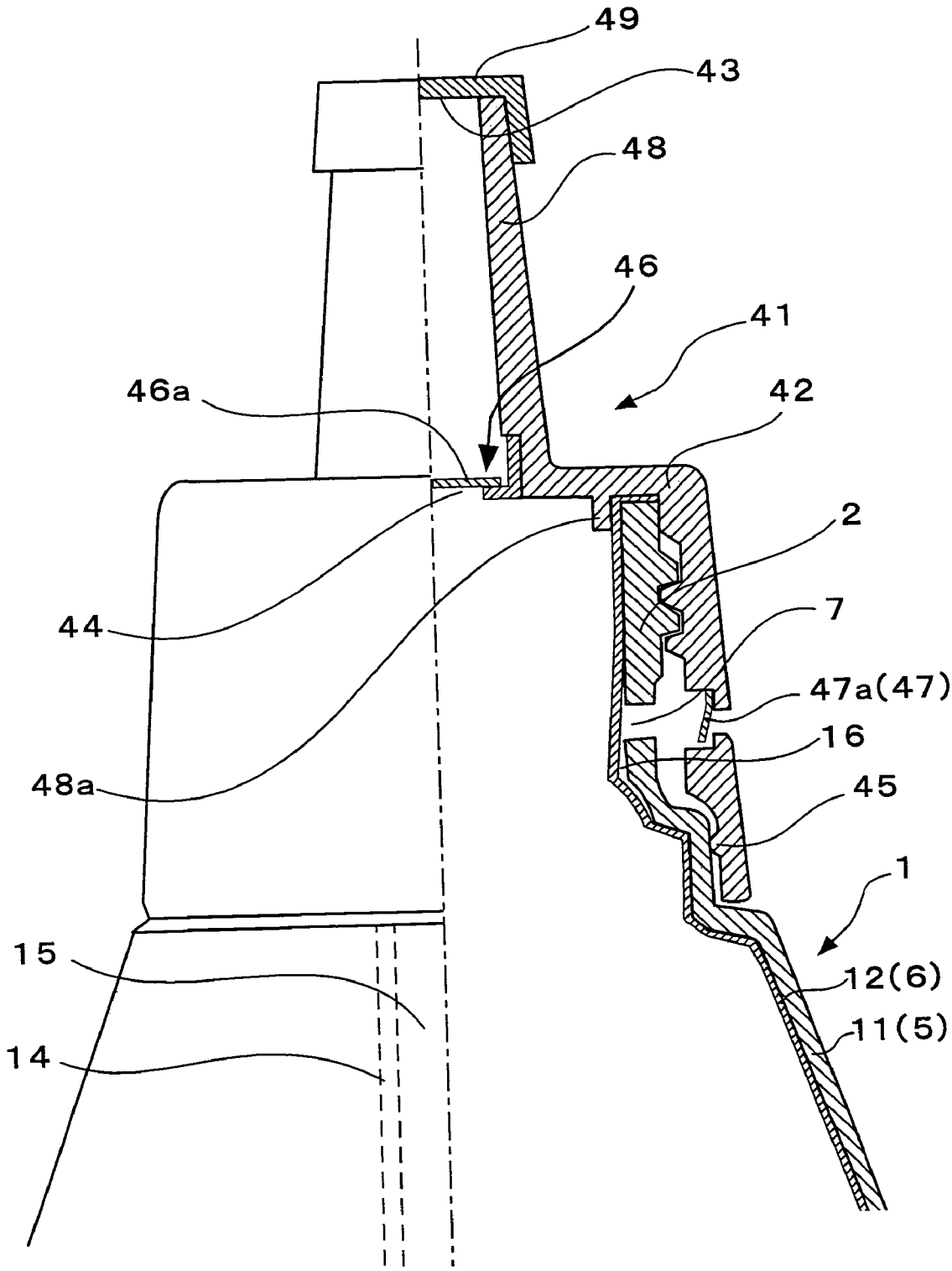
FIG. 19 is a partially enlarged side elevational view showing the embodiment of FIG. 17, with the right half being illustrated in the longitudinal section.

FIGS. 17 and 19 show the discharge cap 41, which has been screwed on the container 1 in the third embodiment of this invention. The discharge cap 41 comprises a main cap portion 42 and a discharge cylinder 48. The main cap portion 42 has a top surface through which an opening 44 is provided at the center and has screw thread notched on the inner wall to screw together with the neck 2 of the container 1. The discharge cylinder 48 is disposed on the top surface of the main cap portion 42, and stands upright on the edge of the opening 44. The content 31 is discharged outside from the discharge port 43 at the upper end of the discharge cylinder 48. Cover cap 49 covers the discharge port 43.

The discharge cap 41 is screwed on the neck 2 of the container 1. It comprises a seal guide 48*a*, which hangs down from under the top surface of the main cap portion 42, and also comprises a sealing portion 45, which is disposed at the lower end of the inner wall of the main cap portion 42. The discharge cap 41 is tightly fitted around the container 1 as the seal guide 48*a* and the sealing portion 45 are in tight contact with the upper end of the inner wall and the lower end of the outer wall, respectively, of the neck 2 of the container 1.

The discharge cap 41 is provided with the first check valve mechanism 46 having the first check valve 46*a* at the opening 44 of the main cap portion 42. This valve usually has the checking function to close the opening 44 and to prevent outside air from coming in the inner container 6. When the container 1 is squeezed to discharge the content 31, the valve acts to open the opening 44 due to the inner pressure of the inner container 6.

In addition, the discharge cap 41 is provided with the second check valve mechanism 47 comprising the second check valve 47*a* at places opposite to the air introduction ports 7 disposed in the neck 2. This second check valve 47*a* has the function to open the ports 7 and introduce air into the void 16 between the outer layer 11 and the inner layer 12 through the air introduction ports 7 and the check function to close the ports 7 and prevent air from escaping outside.

The container 1 in the third embodiment of this invention is further described for its state of use. When the container 1 in the above-described configuration is used, it is squeezed at first, and this squeeze closes the second check valve 47*a*. The pressure rises in the inner container 6, which contains the content 31, and opens the first check valve 46*a*. As a result, the content 31 is discharged outside through the discharge port 43 at the tip of discharge cap 41. The inner container 6 deflates and deforms in response to a decrease in the volume of the content 31.

The restricted zones 15 themselves have a width as large as 17 mm. If a restricted zone 15 comprised the adhered zones 14 that were laminated with the outer layer 11 and the inner layer 12 over the entire width of the restricted zone 15, then each restricted zone 15 would become a side rib that is difficult to deform, as compared to the body of the outer container 5, which has a relatively thin wall to give flexibility to the body 3. In that case, uniform squeeze deformation would not be possible, and the rib portions would be felt strange when the container 1 is held with a hand.

However, in the third embodiment, each restricted zone 15 comprises a pair of adhered zones 14 having a width as narrow as about 2 mm. When the body 3 of the container 1 is squeezed at whatever position, the body 3 can be deformed to a similar extent, and the above-described strange feeling can be eliminated.

Then, when the squeeze of the container 1 is stopped to release the pressure applied onto the body 3, the outer container 5 begins restoring its original shape because of its resilient, restoring force, and the air in the void 16 between the outer layer 11 and the inner layer 12 has a reduced pressure. As a result, the pressure inside the inner container 6 returns to atmospheric pressure, and the first check valve 46*a* closes, thus allowing the discharge of the content 31 to come to a halt.

As the recovery to the original shape of the outer container 5 goes on, the inner container 6 still remains deflated, and the second check valve 47*a* opens. Outside air is sucked into the void 16 between the outer layer 11 and the inner layer 12 through the air introduction ports 7. During this process the detachment goes underway between the outer layer 11 and the inner layer 12.

Figure 20:
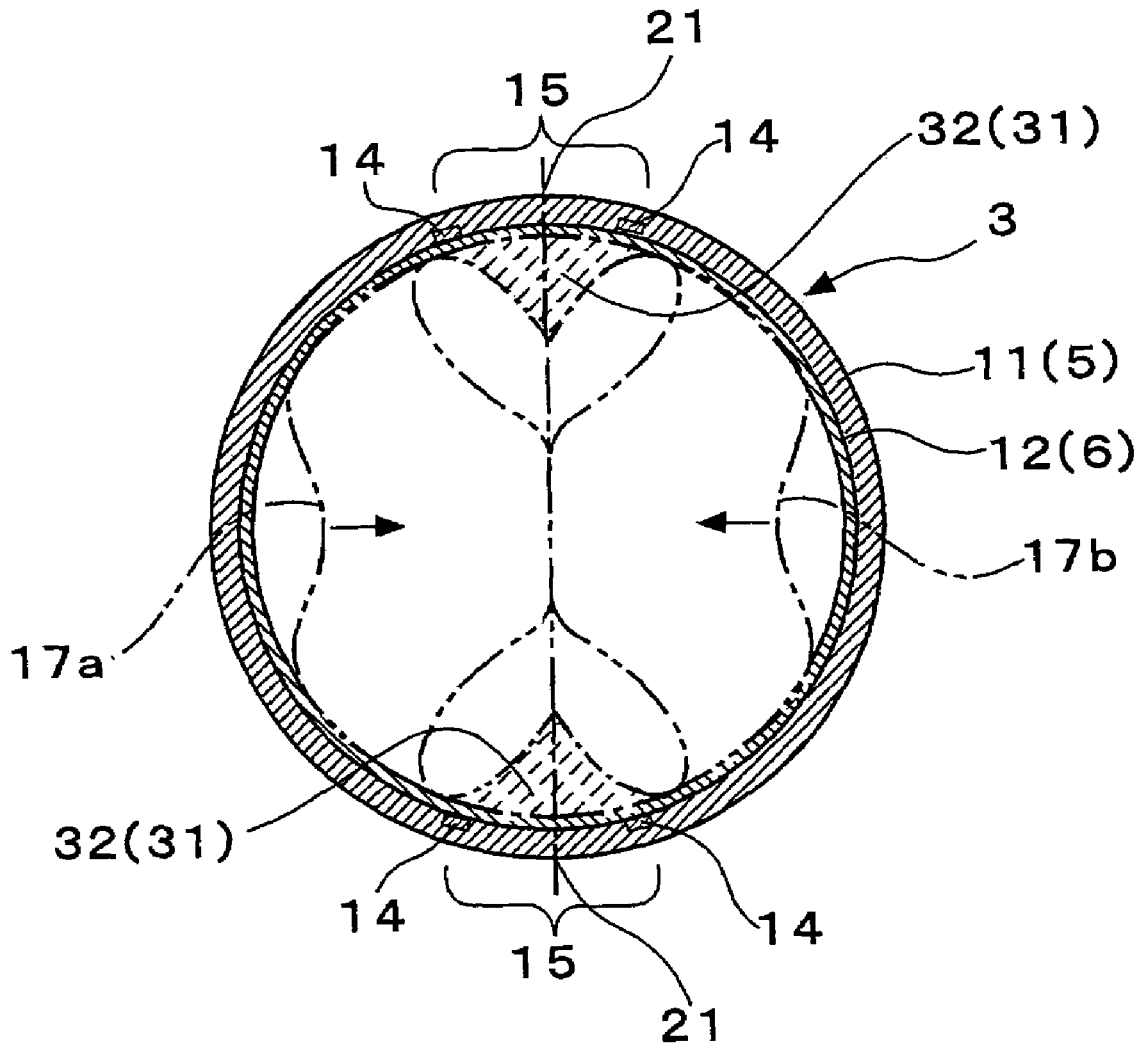
FIG. 20 is an explanatory drawing that shows the trend in the deformation of the inner layer in the embodiment of this invention illustrated in the same cross-sectional plan view as FIG. 18.

FIG. 20 is a cross-sectional plan view of the body 3 of the container 1 in the third embodiment of this invention. It is an explanatory drawing that shows the trend in the deformation of the inner layer 12 (or the inner container 6). In the ideal progress of deflationary deformation as observed in the cross-section, the deformable inner layers 17*a* and 17*b*, divided by the restricted zones 15 into the right and left layers, start being pressed inward at the central portions and being deformed first. As this deformation proceeds, the inner layers 17*a* and 17*b* come in contact with each other on the line connecting both parting lines 21. The deflationary deformation goes on as this line of contact extends toward where the restricted zones 15 are located.

If the width of the restricted zones 15 is set at 17 mm, then each of the deformable inner layers 17*a* and 17*b* has a peripheral length of 77 mm. This length is equal to a sum of the diameter of the circle and the width of a restricted zone. When the width of each restricted zone 15 is set at such a length, the flow paths 32 can be secured near the restricted zones 15 even after the deformation has gone on to a large degree. Thus, it is possible to maintain favorable discharge operability to the last moment when there remains little content 31, as shown in FIG. 20.

Figure 21:
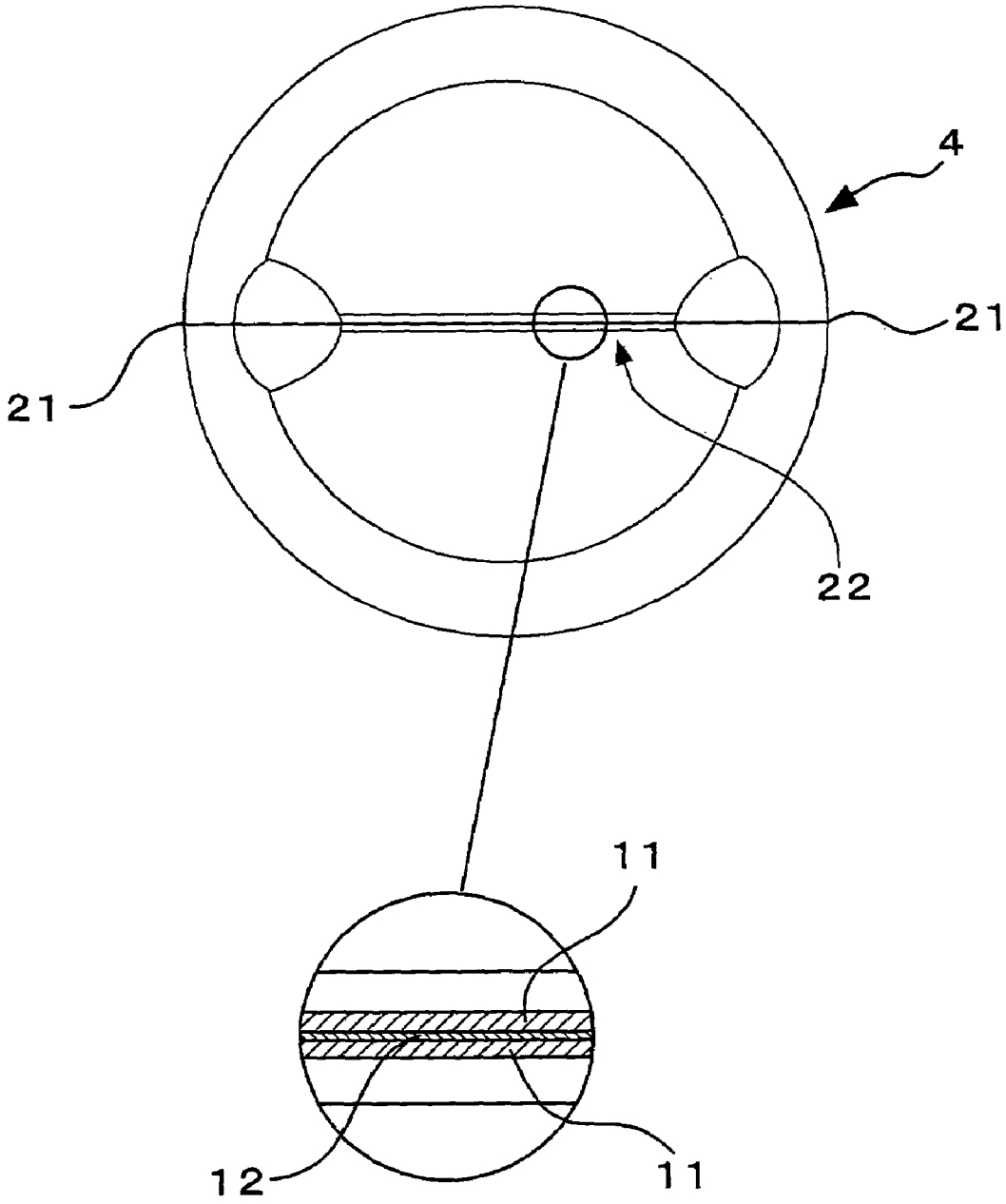
FIG. 21 is a partially enlarged bottom plan view showing the bottom of the container of FIG. 16.

FIG. 21 is a bottom plan view of the container 1 in the third embodiment of this invention. The container 1 is blow-molded in a split mold having a pinch-off structure. The bottom seal 22 of the container 1 is formed at the pinch-off of the mold, and comprises the inner layer 12 sandwiched from both sides with the outer layers 11. The outer layers 11 and the inner layer 12 are peelable from each other.

Figure 24:
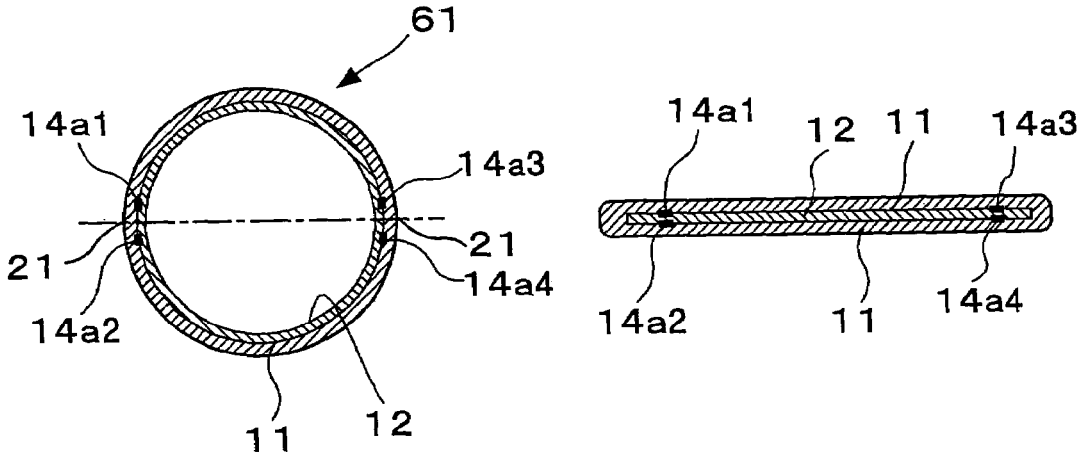
Figure 24:
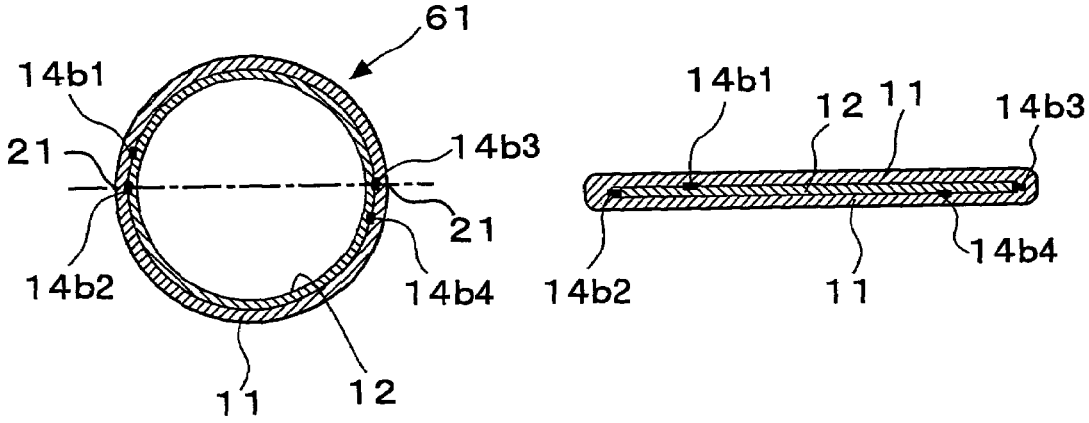

FIG. 24 is explanatory drawings that show the positions of adhered zones 14 on the parison 61 (left drawings) and in the state in which the parison 61 has been pinched off (right drawings). In FIG. 24(*a*), the right and left centerlines (in the width direction) of the restricted zones 15 are in line with the parting line 21. In FIG. 24(*b*), the centerlines are dislocated from the parting lines 21.

In the dislocated case, the adhered zones 14*b*1 and 14*b*4 are located far from the parting lines 21 on the parison 61. When the parison 61 is pinched off, these adhered zones 14*b*1 and 14*b*4 are located nearer to the center of the seal in the direction of seal length, as compared to the adhered zones 14*a*1, 14*a*2, 14*a*3, and 14*a*4 in the aligned case where the centerlines has been disposed on the parting line 21.

Therefore, the adhered and fixed portions of the inner layer 12 and the outer layer 11 can be formed at two points close to the center of the bottom seal 22 of the container 1. These adhered portions near the center, along with the other two adhered portions at both ends of the bottom seal 22, serve as junctions against deformation of the laminated bottom seal 22 consisting of the outer layers 11 and the inner layer 12. Even if a force of any kind is applied on the bottom seal 22, a total of four portions can resist such a force and safely prevent the bottom seal 22 from cracking.

It should be noted that the cross-sectional shape of the body 3 is not limited to the circular one described in the above third embodiment, but that the action and effect of this invention can be fully achieved likewise in the elliptical or other shapes to be used generally in the blow-molded products.

In the above third embodiment, the air introduction mechanisms comprise a pair of air introduction ports 7, which are small round holes drilled in the outer layer 11 at the neck 2. The air introduction mechanism is not merely limited to this example, but can also comprises a slit-like port to be located at the bottom seal 22, or can be slits in the neck 2 to be formed by providing the pinch-off at the neck 2 in the blow molding.

EFFECTS OF THE INVENTION

This invention in the above-described configuration has the following effects:

In the invention of claim 1, the restricted zones comprise two or more adhered zones of the vertical strip type. Thus, it is possible for the restricted zones to have a width that is necessary and sufficient to control the deformation of the inner layers and to improve the strength of the bottom seal, without expanding the width of the adhered zones themselves. This invention solves the problems caused by extending the width of the adhered zones themselves, including the problem of defective outer appearance, the problem of hampered uniform squeeze deformation, the problem of strange feel on the part of the users in touching the container with a hand, and the problem of using a large amount of the costly adhesive resin to form the adhered zones.

The invention of claim 2 makes it possible to achieve the cooling of the container bottom seal quickly and sufficiently. Thus, the container production cycle can be improved to a level similar to the level achieved with ordinary blow-molded products.

There is no need of utilizing a special mold in which mold cooling efficiency has to be taken into consideration. The plant and equipment cost can also be reduced drastically since ordinary molds can be used.

The width of the restricted zones can be extended substantially without increasing the consumption of the costly adhesive synthetic resin material. Thus, the non-peelable adhesion of the outer layer to the inner layer can be achieved over a wide range. It is possible, therefore, to prevent the bottom securely, sufficiently, and inexpensively from having a decreased mechanical strength that tends to result when the outer layer and the inner layer are molded from synthetic resins that are peelable from each other.

Since either or both restricted zones comprise two or more adhered zones, a large allowable margin of size error can be tolerated when lower ends of both restricted zones take the end-to-end position from opposite directions on the bottom seal. This leads to high efficiency in the container production.

In the invention of claim 3, the width of the restricted zones can be extended economically and changed easily so that mechanical strength of the bottom can be reinforced to a right degree in which any loss of material can be eliminated.

In the invention of claim 4, the same effect as in the invention of claim 3 is available. In addition, the lower ends of both restricted zones can be easily set at suitable facing positions.

In the invention of claim 5, the lower ends of both restricted zones can be put in a state almost similar to the direct bonding between the lower ends facing each other at the end-to-end position. Thus, quite strong adhesive bonding can be obtained securely at the bottom seal where the lower ends of the restricted zones are located.

In the invention of claim 6, the bottom seal, the place where lower ends of the restricted zones are located, is maintained at a relatively stable, constant position. There is no external force acting on this bottom area to peel the outer layer from the inner layer that has joined the outer layer. The bonding of the outer layer to the inner layer is thus kept relatively stably over a large width range.

In the invention of claim 7, a total of four adhered zones are arranged in such configuration that strong bonding can be achieved over the width range of the restricted zones, including the width of the middle zone. The adhered zones themselves can be set at a narrow width so as to be able to reduce the amount of the costly adhesive resin material to be used.

In the invention of claim 8, it is possible to secure the content flow path and to consume almost all the content while maintaining good discharging ability.

In the configuration of claim 9, outside air comes in through the air introduction ports disposed near the parting line. Thus, the deflationary deformation of the inner layers can be allowed to proceed in the symmetrical pattern, and the content can be smoothly discharged.

In the invention of claim 10, a restricted zone is formed from a pair of adhered zone having a narrow width. Since there is no rib-like hardly deformable portion, it is possible to provide a squeezable container, which has uniform, favorable squeezability, no strange feel, and no bad outer appearance caused by the formation of adhered zones.

In the invention of claim 11, the discharge cap provided with the first check valve mechanism is fitted to the neck of the container. When this container is used as a pouring vessel, it is possible to provide the pouring vessel of the squeezable type, which especially prevents the inflow of outside air.

In the invention of claim 12, the front and rear surfaces perpendicular to the parting lines are used to attach or print a label, and can be made smooth with no irregularity, by locating the restricted zones near the respective parting lines. In this configuration, there is also provided a container having good outer appearance and high value as a commercial product.

In the invention of claim 13, there are right and left centerlines of the restricted zones on the respective parting lines. The restricted zones can be provided at right angles to the front of the container. This makes outer appearance further better. Good operability and discharging ability can be obtained since the inner layers can be deformed symmetrically to the line connecting the right and left parting lines.

In the invention of claim 14, the vertical centerline of each restricted zone is dislocated from the position of the parting line. In that case, the adhered zones on the far sides come closer to the center of the bottom seal in the direction of seal length than the adhered zones on the near sides. Thus, the adhered zones can safely prevent the bottom seal from cracking.

In the invention of claim 15, the circular cross-section of the body, combined with the action and effect of the restricted zones configured by narrow adhered zones, permits the squeezable container to be squeezed similarly from any direction.

In the invention of claim 16, the body has either the circular cross-section or the elliptical cross-section. Favorable discharge operability can be secured to the last moment, by setting the width of the restricted zones at a certain level to be determined by this cross-sectional shape.

In the invention of claim 17, the air introduction ports can be opened without giving adverse effects on the outer appearance of the container.

These ports can be drilled safely and simply in the after processing.

What is claimed is:

1. A blow-molded container comprising:

an outer layer that forms an outer shell of a finite shape, wherein the outer layer includes air introduction ports;

a flexible inner layer that is peelably laminated with the outer layer, wherein the inner layer forms an inner bag and the air introduction ports allow air into a void between the outer layer and the inner layer; and a pair of restricted zones of a vertical strip type, which is formed axisymmetrically on a central axis of the container to adhere and fix the outer layer and the inner layer over an entire height of the container, wherein the pair of restricted zones do not overlap the air introduction ports and at least one of the restricted zones comprises two or more parallel adhered zones of a vertical strip type.

2. The blow-molded container according to claim 1, wherein:

the restricted zones are provided at positions opposite to each other and are separated from each other by a parting line, and a lower end of a first restricted zone is disposed at a partly or wholly end-to-end position facing that of a second restricted zone on a bottom seal formed at a bottom when the bottom has been pressed flat with a pinch-off of a blow mold.

3. The blow-molded container according to claim 2, wherein each of the restricted zones comprises two or more adhered zones.

4. The blow-molded container according to claim 3, wherein each of the restricted zones comprises a plural, same number of adhered zones.

5. The blow-molded container according to claim 2, wherein a lower end of each adhered zone belonging to the first restricted zone is disposed at an end-to-end position facing a lower end of an adhered zone belonging to the second restricted zone.

6. The blow-molded container according to claim 2, wherein a lower end of each adhered zone belonging to the first restricted zone is dislocated from that of a corresponding adhered zone belonging to the second restricted zone such that an end-to-end facing relationship is set so that corresponding portions of the inner layer are not flexibly deformed.

7. The blow-molded container according to claim 2, wherein:

each of the restricted zones comprises a pair of adhered zones, and a lower end of each adhered zone is disposed at a wholly end-to-end position facing a lower end of an opposite adhered zone.

8. The blow-molded container according to claim 2, wherein each restricted zone is set at a width that enables deformable inner layers to block a cross-sectional flow path in the container when contents within the container have been consumed.

9. The blow-molded container according to claim 2, wherein the air introduction ports are provided axisymmetrically on the central axis of the container at two points in the outer layer on or near the parting line.

10. The blow-molded container according to claim 1, wherein:

the outer layer forms an outer container and the outer container is flexible such that the outer container is squeezable and recoverable to an original shape;

the inner layer forms an inner container for receiving contents inside and the inner container is capable of being deflated and deformed inward with a decrease in inner pressure; and the restricted zones each include a pair of adhered zones.

11. The blow-molded container according to claim 10, wherein:

a discharge cap fitted to a neck of the container is provided with a first check valve mechanism that prevents back flow of the content into the inner container and also prevents an inflow of outside air, and a second check valve mechanism is provided to open or close the air introduction ports in a manner that makes it impossible for air to escape therefrom.

12. The blow-molded container according to claim 10, wherein the pair of restricted zones is provided near right and left parting lines of the container.

13. The blow-molded container according to claim 12, wherein a vertical centerline of each restricted zone is positioned on the parting line.

14. The blow-molded container according to claim 12, wherein a vertical centerline of each restricted zone is dislocated from the parting line.

15. The blow-molded container according to claim 10, wherein a body of the container has a circular shape in cross-section.

16. The blow-molded container according to claim 10, wherein a body has either one of the circular shape or the elliptic shape in cross-section, with a width of the restricted zones being set at (¼)(L-2D1) wherein L is a peripheral length in the cross-section of the body, and D1 is the length of a long axis in the cross-section of the body.

17. The blow-molded container according to claim 1, wherein the air introduction ports are provided in a neck of the outer layer.

* * * * *